US012458900B2

(12) United States Patent
Tankel et al.

(10) Patent No.: US 12,458,900 B2
(45) Date of Patent: Nov. 4, 2025

(54) TOY SYSTEM

(71) Applicant: MOOSE CREATIVE MANAGEMENT PTY LIMITED, Cheltenham (AU)

(72) Inventors: Hannan Yacob Tankel, Blackburn North (AU); Nazanin Keyvanloo, Doncaster (AU); Ross Monks, Cornwall (GB); James Austin-Smith, Perranwell Station (GB)

(73) Assignee: MOOSE CREATIVE MANAGEMENT PTY LIMITED, Cheltenham (AU)

( * ) Notice: Subject to any disclaimer, the term of this patent is extended or adjusted under 35 U.S.C. 154(b) by 196 days.

(21) Appl. No.: 18/461,014

(22) Filed: Sep. 5, 2023

(65) Prior Publication Data

US 2024/0075397 A1 Mar. 7, 2024

Related U.S. Application Data

(60) Provisional application No. 63/374,880, filed on Sep. 7, 2022.

(51) Int. Cl.
*A63H 33/00* (2006.01)
*A63H 3/52* (2022.01)

(52) U.S. Cl.
CPC ..... *A63H 33/00* (2013.01); *A63H 3/52* (2013.01)

(58) Field of Classification Search
CPC ..... A63H 3/50; A63H 3/52; A63F 2009/0012; A63F 2009/0013; A63F 2009/003; A63F 2009/0053; B65D 11/02; B65D 11/04; B65D 11/06
See application file for complete search history.

(56) References Cited

U.S. PATENT DOCUMENTS 4,026,066 A 5/1977 Reiner et al.
4,941,590 A * 7/1990 Pantaleo ..... A47G 19/2227 206/217

(Continued)

FOREIGN PATENT DOCUMENTS

JP 61 4698 1/1986

OTHER PUBLICATIONS

PCT International Search Report and Written Opinion for PCT/US2023/031971 dated Dec. 11, 2023.

*Primary Examiner* — Thomas M Sember
(74) *Attorney, Agent, or Firm* — KNOBBE, MARTENS, OLSON & BEAR, LLP

(57) ABSTRACT

An interactive toy system includes a barrel forming an internal space capable of holding a figurine, and a bottle forming an enclosure to house the barrel. An inter-wall space is formed between the barrel and the bottle for holding a liquid. The wall of the bottle and the wall of the barrel are configured to have opaque portions. The opaque portions of the barrel wall and the bottle wall are initially oriented to block the user's view inside the barrel. When ingredients are added to the inter-wall space with water, a liquid of opaque color is created. Then the barrel is rotated and an ingredient or material (e.g., liquid, powder, etc.) is mixed with the liquid to clarify the liquid revealing the figurine inside the internal space. The ingredient or material can further create a fizz in the inter-wall space.

22 Claims, 28 Drawing Sheets

(56) References Cited

U.S. PATENT DOCUMENTS

| | | | | |
|---|---|---|---|---|
| 5,236,384 | A * | 8/1993 | Fabricant | A63H 3/36 273/291 |
| 5,702,282 | A * | 12/1997 | Beckman | A63H 3/52 472/72 |
| 7,090,369 | B1 * | 8/2006 | Jordan | F21V 35/00 362/396 |
| 10,046,883 | B1 | 8/2018 | Lui et al. | |
| 2006/0040581 | A1 * | 2/2006 | Davis | A47G 19/2227 446/71 |
| 2021/0228994 | A1 | 7/2021 | O'Brien et al. | |
| 2022/0118373 | A1 | 4/2022 | Del Giudice et al. | |

* cited by examiner

TOY SYSTEM

CROSS-REFERENCE TO RELATED APPLICATION

This application claims benefit under 35 U.S.C. 119(e) to U.S. Provisional Patent App. No. 63/374,880, filed Sep. 7, 2022, the entire disclosure of which is hereby incorporated by reference herein in its entirety. Any and all priority claims identified in the Application Data Sheet, or any corrections thereto, are hereby incorporated by reference under 37 CFR 1.57.

BACKGROUND

Field

A toy system is described. More specifically, embodiments of the toy system provide an interactive experience for a user to reveal a figurine.

SUMMARY

The present disclosure is directed to a toy system. An aspect of the disclosure is a toy system that has an internal space for housing a toy. The system comprises a bottle and a barrel rotatably disposed in the bottle so as to rotate from a first position to a second position. When the barrel is in the first position the internal space is not visible from outside the bottle. When the barrel is in the second position the internal space is visible from outside the bottle.

Additional aspects further comprise a handle configured to allow a user to rotate the barrel.

Additional aspects further comprise the toy disposed in the internal space, the toy being accessible when the barrel is removed from the bottle.

Additional aspects further comprise wherein a wall of the barrel and a wall of the bottle form an inter-wall space configured to hold a liquid.

Additional aspects further comprise wherein a capsule containing an ingredient configured to mix with the liquid.

Additional aspects further comprise wherein the capsule is disposed in the bottle and above the barrel.

Additional aspects further comprise wherein the capsule is disposed in the bottle below the barrel.

Additional aspects further comprise wherein the ingredient is configured to change a transparency of the liquid.

Additional aspects further comprise wherein the ingredient is configured to create fizz in the liquid.

Additional aspects further comprise one or more spikes, wherein one of the one or more spikes or the capsule is rotatable relative to the bottle so as to align with the other one of the one or more spikes or the capsule.

Another aspect of the disclosure is a toy system having an internal space for housing a toy. The toy system comprises a bottle having an opaque portion and a transparent/translucent portion and a barrel disposed in the bottle, the barrel being rotatable relative to the bottle from a first position to a second position, the barrel having an opaque portion and a transparent/translucent portion. The opaque portion of the barrel overlaps the transparent/translucent portion of the bottle when the barrel is in the first position so that a view of the toy in the internal space from outside the bottle is obfuscated. The transparent/translucent portion of the barrel overlaps the transparent/translucent portion of the bottle when the barrel is in the second position so that the toy is visible from outside the bottle.

Additional aspects further comprise wherein a wall of the barrel and a wall of the bottle form an inter-wall space configured to hold a liquid.

Additional aspects further comprise a capsule containing an ingredient configured to mix with the liquid.

Additional aspects further comprise wherein the ingredient is configured to change a transparency of the liquid.

Additional aspects further comprise wherein the ingredient is configured to create fizz in the liquid.

Another aspect of the disclosure is a toy system comprising a barrel having an inner wall forming an internal space configured to hold a toy, a bottle having an outer wall forming an enclosure to house at least a portion of the barrel therein, wherein the outer wall and the inner wall are spaced apart forming an inter-wall space configured to hold a liquid, and a handle configured to rotate the barrel between at least a first position and a second position relative to the bottle.

Additional aspects further comprise a capsule configured to hold an ingredient, wherein actuation of the handle releases the ingredient into the inter-wall space.

Additional aspects further comprise wherein the ingredient is a clarifying agent configured to change a transparency of the liquid.

Additional aspects further comprise wherein the ingredient is configured to create fizz in the liquid.

Additional aspects further comprise wherein a first portion of the inner wall and a first portion of the outer wall are opaque, and wherein a second portion of the inner wall and a second portion of the outer wall are transparent or translucent.

Additional aspects further comprise wherein the first portion of the inner wall overlaps the second portion of the outer wall when the barrel is in the first position, and wherein the first portion of the inner wall overlaps the first portion of the outer wall when the barrel is in the second position.

Additional aspects further comprise wherein the liquid is opaque.

BRIEF DESCRIPTION OF THE DRAWINGS

Various embodiments are depicted in the accompanying drawings for illustrative purposes and should in no way be interpreted as limiting the scope of the embodiments. In addition, various features of different disclosed embodiments can be combined to form additional embodiments, which are part of this disclosure.

DETAILED DESCRIPTION

The present description will be directed in particular to elements forming part of, or cooperating more directly with, apparatus and methods in accordance with the present invention. It is to be understood that elements not specifically shown or described may take various forms well known to those skilled in the art.

Embodiments of the toy system disclosed herein, provides a user or a group of users an experience of revealing a toy, such as a figurine. For example, when the toy system is unpackaged, the user's view into the internal space holding the figurine is blocked. This increases the user's curiosity and anticipation. In some embodiments, after one or more actions of playing with the toy system, including, for example, adding ingredients into the toy system, shaking the toy system, actuating a handle (e.g., rotating and/or pressing), the user's view into the internal space slowly clears until the figurine is eventually revealed inside the internal space. The user can then open the toy system to access the figurine. The actions make the unboxing and toy revealing process more enjoyable and exciting.

Figure 1:
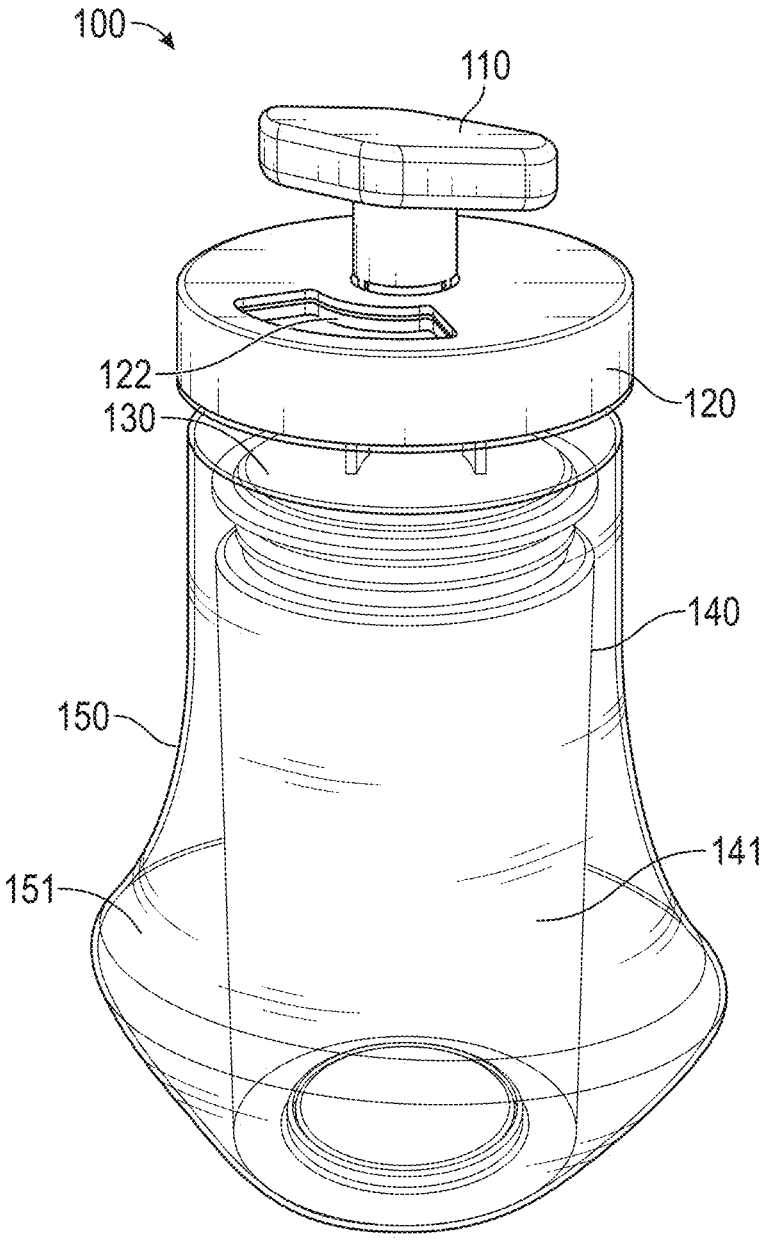
FIG. 1 is a perspective view of a toy system according to an embodiment of the disclosure.

FIG. 1 is a perspective view of a toy system 100 according to an embodiment of the disclosure. In certain embodiments, the toy system 100 comprises a bottle 150 and a barrel 140 disposed in the bottle 150. In certain embodiments, the barrel 140 is rotatably disposed in the bottle 150 so as to rotate from a first position to a second position. In certain embodiments, the toy system 100 comprises a barrel lid 130 that is coupled with the barrel 140. In certain embodiments, the toy system 100 comprises a bottle lid 120 that is coupled with the bottle 150. In certain embodiments, the toy system 100 comprises a handle 110.

As shown in FIG. 1, in certain embodiments, at least a portion of each of the bottle 150 and the barrel 140 have a transparent or translucent wall. In certain embodiments, the barrel 140 has a wall which forms an internal space 141 adapted to house an object, i.e., a figurine or a toy. Opening the barrel lid 130 can allow the user to access the internal space 141.

In certain embodiments, the barrel 140 is disposed inside the bottle 150 and rests on a bottom surface of the bottle 150. In certain embodiments, when assembled, the wall of the barrel 140 and the wall of the bottle 150 form an inter-wall space 151 therebetween. In certain embodiments, an opening 122 through the bottle lid 120 connects the inter-wall space 151 to the outside of the toy system 100. In certain embodiments, the bottle lid 120 is threaded on the bottle 150. In certain embodiments, actuating the handle 110 (e.g., rotating and/or pressing) activates the toy system 100.

Figure 2:
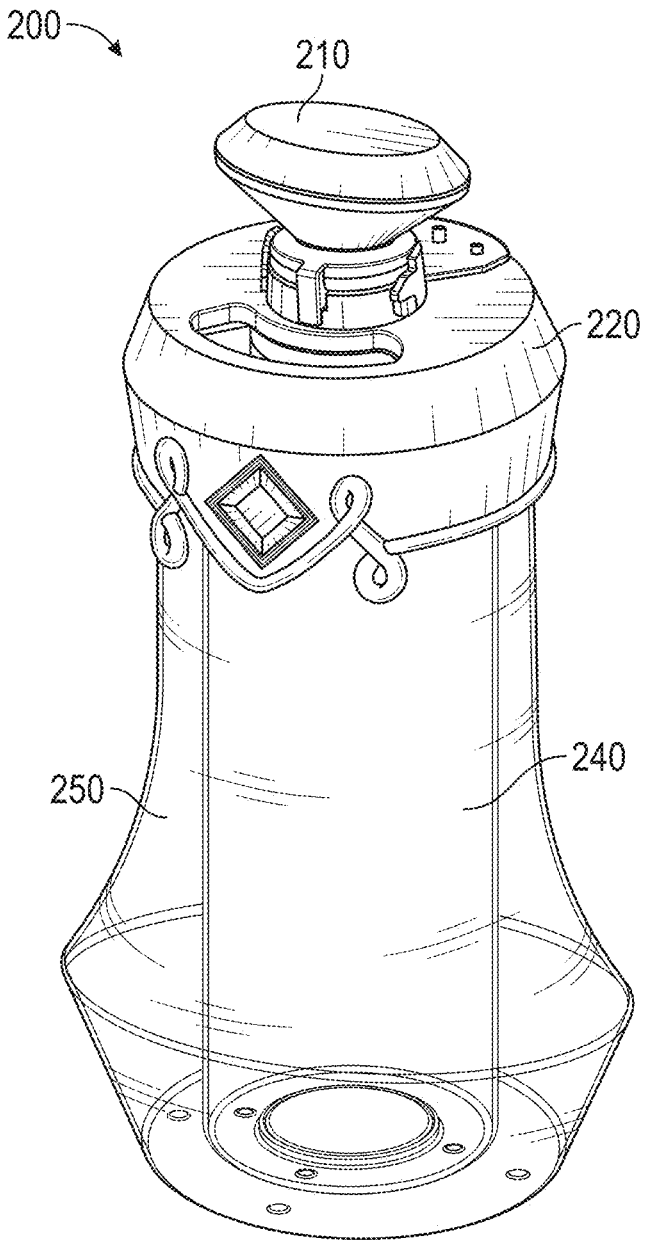
FIG. 2 is a perspective view of an alternative embodiment of the toy system that has a different exterior appearance than the embodiment shown in FIG. 1.

FIG. 2 is a perspective view of an alternative embodiment of the toy system 200 that has a different exterior appearance than the embodiment shown in FIG. 1. In certain embodiments, the toy system 200 comprises a bottle 250 and a barrel 240 disposed in the bottle 250. In certain embodiments, the barrel 240 is rotatably disposed in the bottle 250 so as to rotate from a first position to a second position. In certain embodiments, the toy system 200 comprises a bottle lid 220 that is coupled with the bottle 250. In certain embodiments, the toy system 200 comprises a handle 210.

The toy system 200 is similar to the toy system 100 illustrated in FIG. 1, except both the bottle 250 and the handle 210 have different ornamental appearances and connection mechanisms. For example, the coupling between the bottle lid 220 and the bottle 250 may be threaded, a press fit connection, or may employ any other connection mechanism, that may not be the same as the coupling between the bottle lid 120 and the bottle 150.

Figure 3:
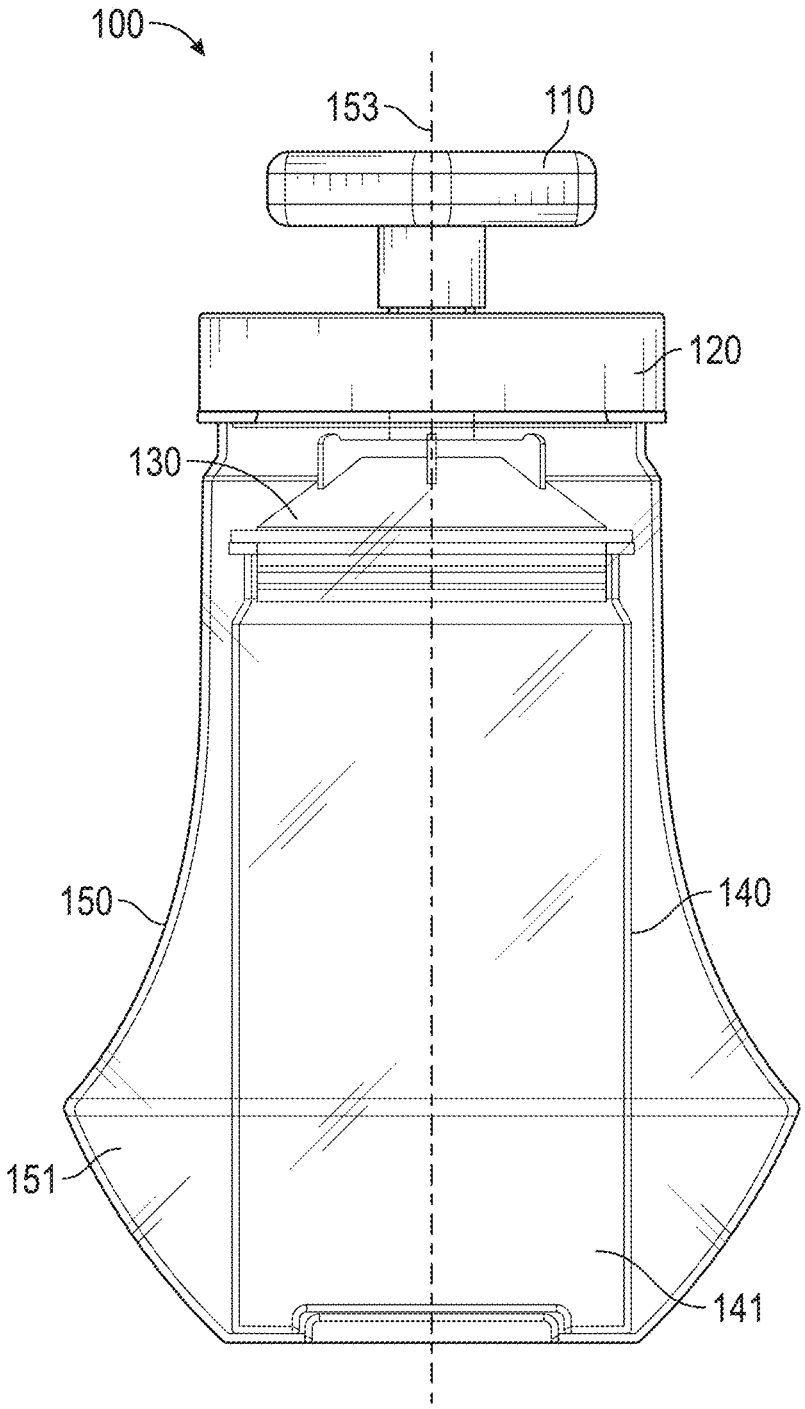
FIG. 3 is a front view of the toy system in FIG. 1.

FIG. 3 is a front view of the toy system 100 in FIG. 1. As is illustrated in FIG. 3, the barrel 140 rotates about an axis 153. In certain embodiments, the bottle 150 and the barrel 140 are arranged so as to be coaxial.

Figure 4:
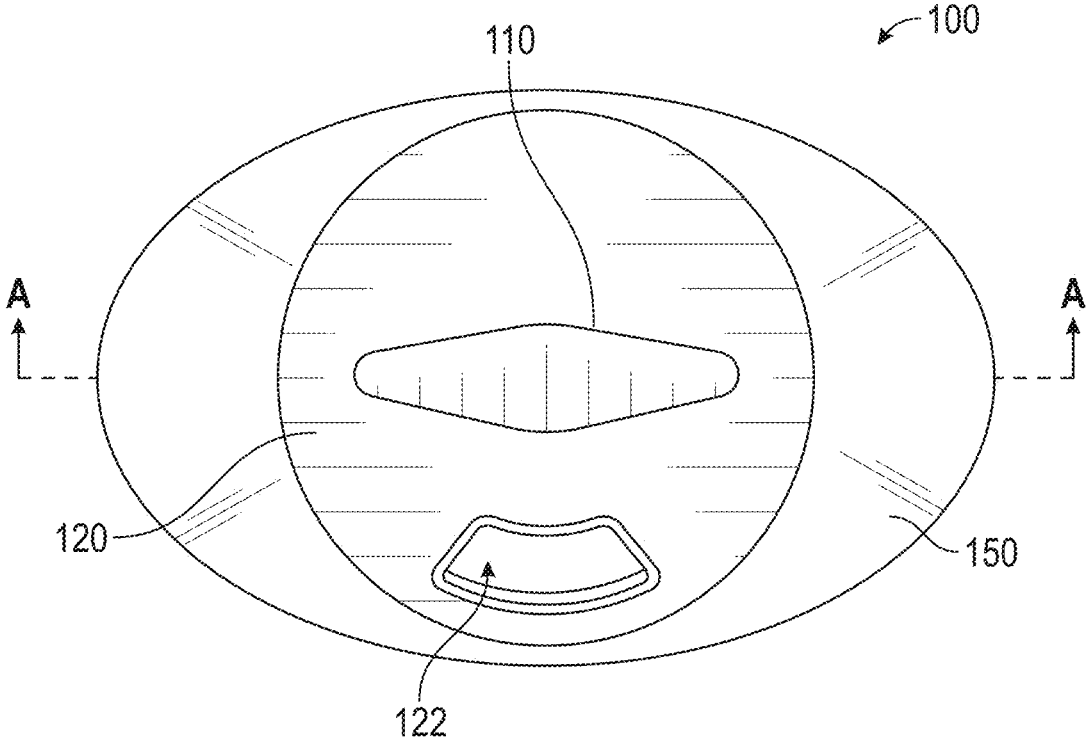
FIG. 4 is a top view of the toy system in FIG. 1.

FIG. 4 is a top view of the toy system 100 shown in FIG. 1. The opening 122 through the bottle lid 120 is illustrated in FIG. 4. In certain embodiments, the bottle 150 has an oval shape. In other embodiments, the bottle 150 can have a round, square, or any other shape. The bottle 150 and the barrel 140 can have different shapes, as long as the wall of the barrel 140 is able to rotate within the wall of the bottle 150.

Figure 5A:
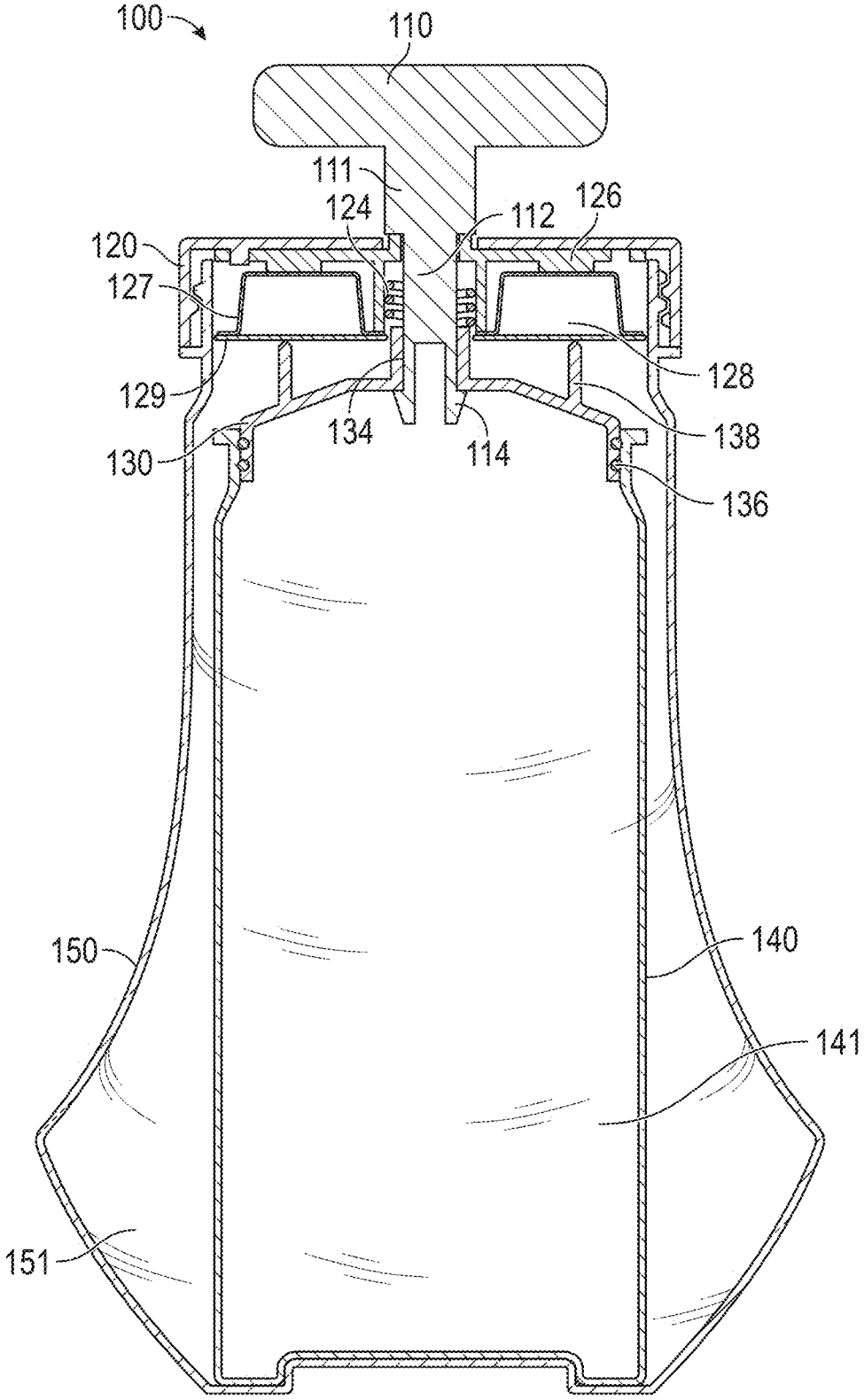
FIG. 5A is a cross-sectional view of the toy system in FIG. 1 taken along lines A-A in FIG. 4 showing a barrel disposed inside a bottle and a handle in a raised position.

FIG. 5A is a cross-sectional view of the toy system 100 in FIG. 1 taken along lines A-A in FIG. 4 showing the barrel 140 disposed inside the bottle 150 and the handle 110 in a raised position. In certain embodiments, the handle 110 is coupled to the barrel lid 130 by an interacting structure 114.

As seen in FIG. 5A, a portion of the interacting structure 114 on the handle 110 comprises one or more posts each having a hook feature to secure in place. In certain embodiments, the one or more posts extend downwardly from a shaft 112 of the handle 110. The handle 110 can also include additional posts to suit a specific application. For example, where the handle 110 is relatively large, the handle 110 can include four posts annularly arranged for greater stability. In certain embodiments, the at least one post is a single post that has a tubular shape.

In certain embodiments, the posts of the interacting structure 114 can have a variety of lengths and a variety of distances between them, depending upon the particular application and the particular barrel lid 130 with which they are to interact. In certain embodiment, the posts are spaced a common distance or radius from a rotational center of the handle 110.

In certain embodiments, the interacting structure 114 is pushed through a hole 134 in the barrel lid 130 during assembly to a raised position. Once assembled the handle 110 can move up and down between the raised and lowered positions with the shaft 112 guided by the hole 134 in the barrel lid 130, but cannot be easily removed from the hole 134 due to the hook feature on the interacting structure 114. In certain embodiments, a rotating plate 126 and a capsule 128 are disposed between the handle 110 and the barrel lid 130. In certain embodiments, a compression spring 124 is loaded on the shaft 112 of the handle 110 between the barrel lid 130 and a shaft base 111 on the bottle 110 so that the handle 110 is biased towards the raised position. In certain embodiments, one or more O-rings 136 is disposed between the barrel 140 and the barrel lid 130 to achieve a watertight seal. In other embodiments, the barrel lid 130 is threaded with the barrel 140 to form the watertight seal without utilizing O-rings. This tight fit ensures that rotational movement of the barrel lid 130 is effectively transferred to the barrel 140. One or more spikes 138 are disposed on a top surface of the barrel lid 130 and aligned with a bottom surface of the capsule 128.

Figure 5B:
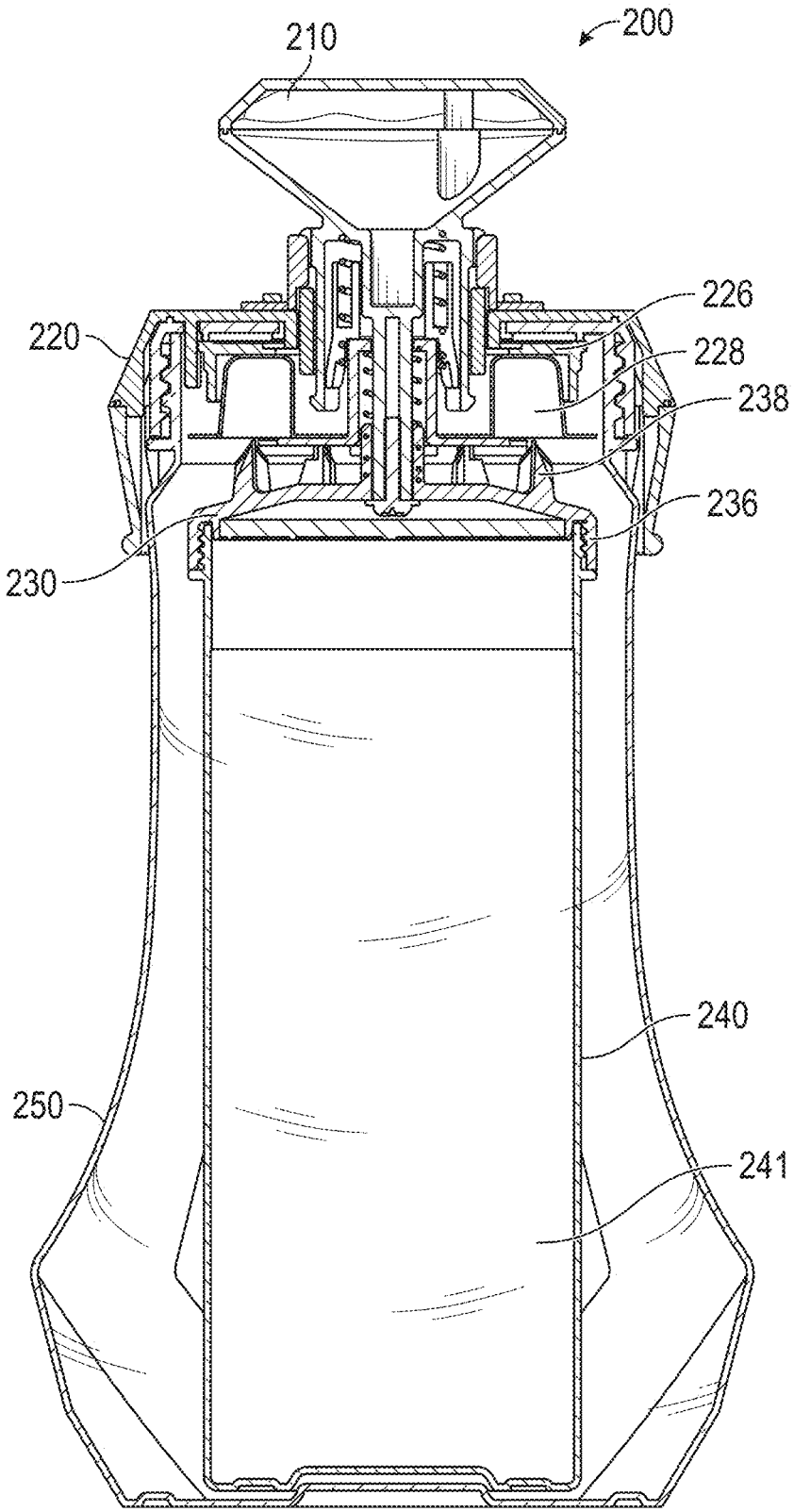
FIG. 5B is a cross-sectional view of the toy system in FIG. 2 showing a barrel disposed inside a bottle and a handle in a raised position.

Referring to FIG. 5B a cross-sectional view of the toy system 200 in FIG. 2 is illustrated to show the barrel 240 disposed inside the bottle 250. In certain embodiments, the handle 210 is coupled to the barrel lid 230 through the bottle lid 220. The coupling mechanism is similar to that shown in FIG. 5A as described above.

Figure 5C:
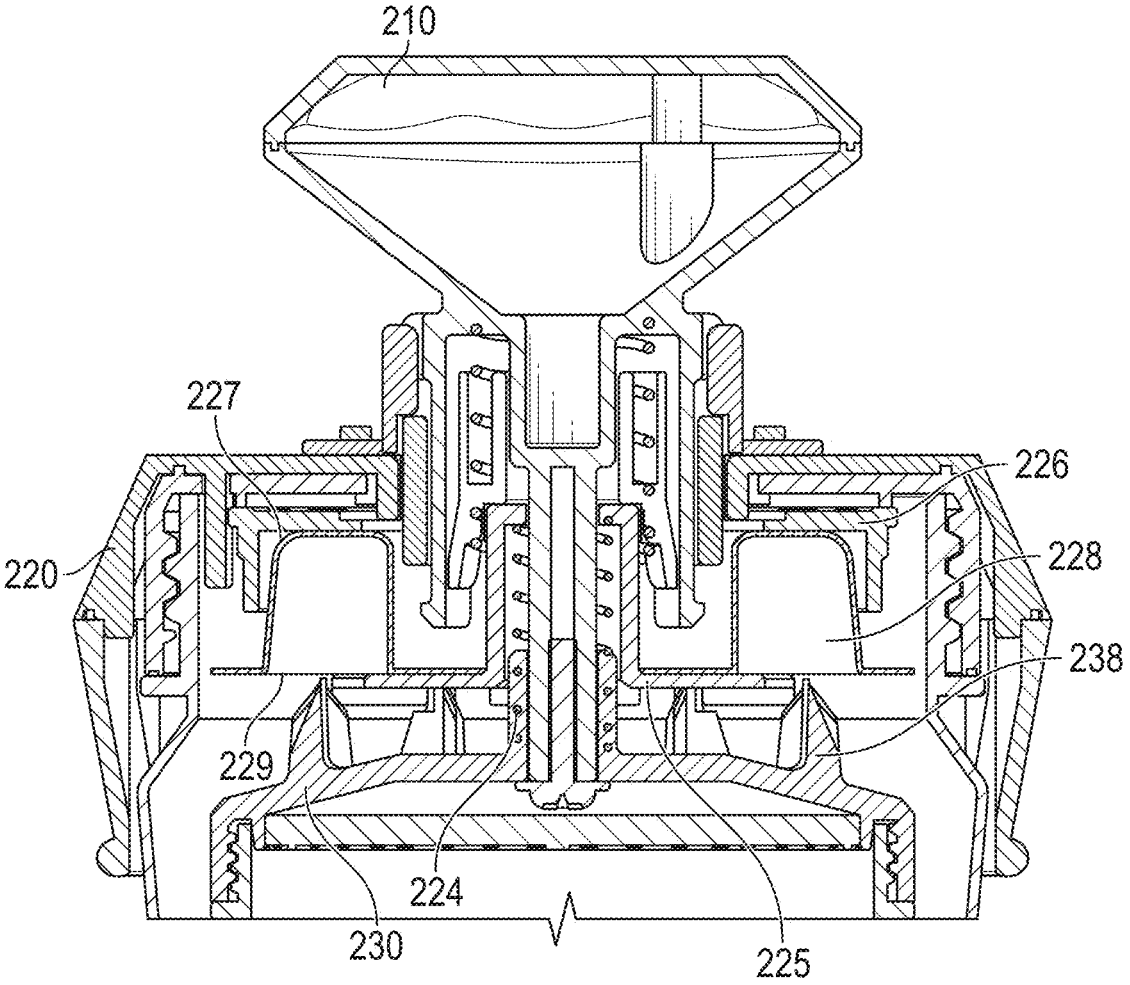
FIG. 5C is a partial cross-sectional view of an upper portion of the toy system in FIG. 5A.

FIG. 5C is a partial cross-sectional view showing an upper portion of the toy system 200 illustrated in FIG. 5B. In certain embodiments, a capsule 228 is disposed under a rotating plate 226 that is disposed under the bottle lid 220. An underside of the capsule 228 comprises a shell 227 that is sealed by a thin plate 229, forming a sealed enclosure configured to hold a liquid or powder material therein. The capsule 228 is supported from underneath by a support plate 225, which is supported by a compression spring 224, as shown in FIG. 5C. In certain embodiments, one or more spikes 238 are formed on the barrel lid 230, pointing to the plate 229.

Similar to the toy system 100 described with regard to FIG. 5A, once assembled the handle 210 can move up and down between a raised position and a lowered position. In certain embodiments, the coupling between the barrel lid 230 and the barrel 240 is through threads, as shown in FIG. 5B.

In certain embodiments, the capsule 128, 228 need not be located above the barrel 140, 240 as is illustrated in FIGS. 5A and 5B. In certain embodiments, the capsule 128, 228 can be located on any other side of the barrel 140, 240. For example, in certain embodiments, the capsule 128, 228 is disposed below the barrel 140, 240. For example, the capsule 128, 228 can be located in a space between the bottom of the bottle 150, 250 and the bottom of the barrel 140, 240. Similarly, the one or more spikes 138, 238 can be located in the space between the bottom of the bottle 150, 250 and the bottom of the barrel 140, 240. For example, in certain embodiments, the one or more spikes 138, 238 are arrange to extend downward from the bottom of the barrel 140, 240 towards the bottom of the bottle 150, 250.

The capsule 128, 228 can be attached to the bottom of the barrel 140, 240 via a circular boss with rotational and linear (up/down) degrees of freedom. In certain embodiments, the capsule 128, 228 can be rotationally locked to the bottom of the bottle 150, 250. When the barrel 140, 240 is rotated, the one or more spikes 138, 238 on the bottom of the barrel 140, 240 align with the capsule 128, 228. When the user presses the handle 110, 210 the one or more spikes 138, 238 are driven through the plate 129, 229 of the capsule 128, 228 to allow liquid to enter the capsule 128, 228.

In certain embodiments, the material in the capsule 128, 228 is a liquid or powder clarifying substance. In certain embodiments, the material in the capsule 128, 228 can further create fizz. In certain embodiments, a compression spring 124, 224 disposed below the barrel 140, 240 returns the barrel 140, 240 to the original position when the user releases the handle 110, 210.

Figure 6A:
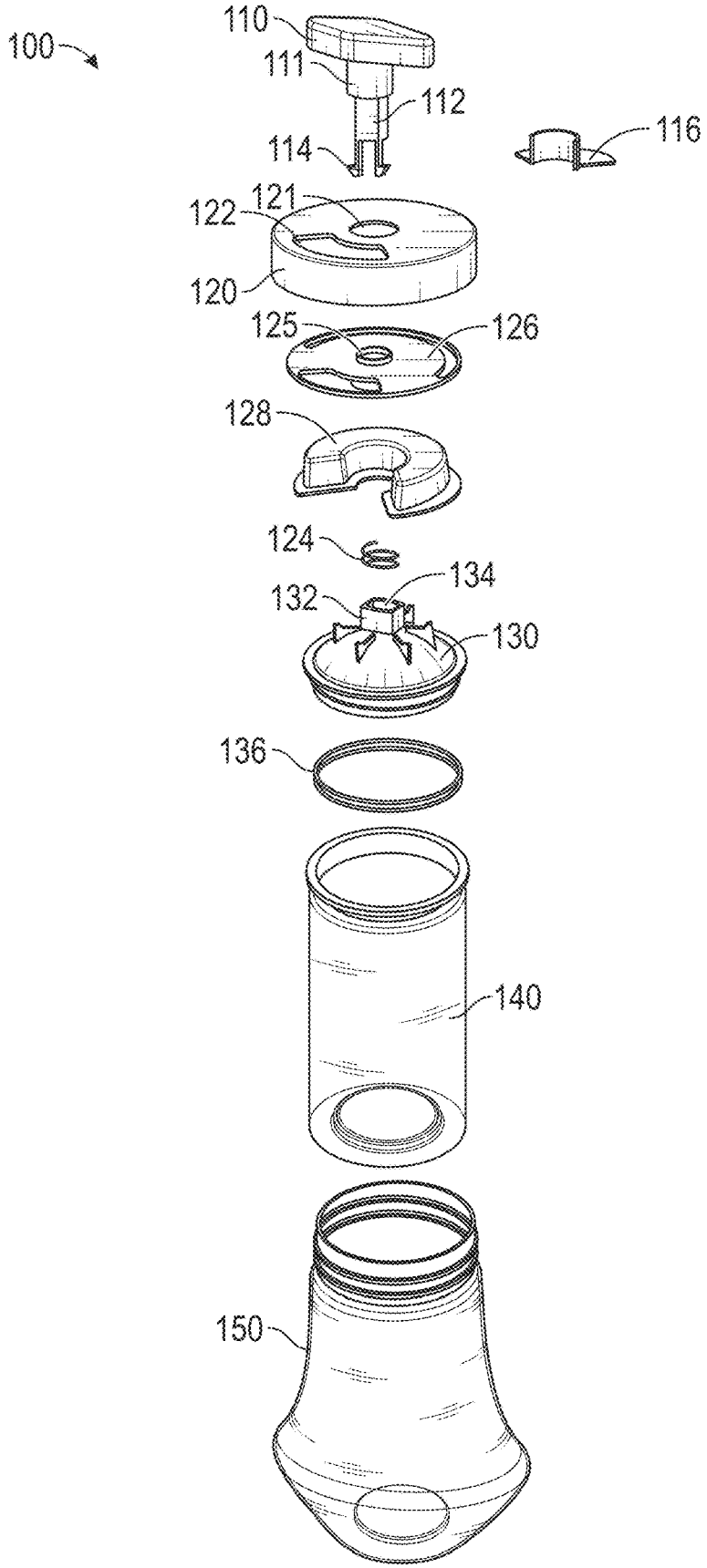
FIG. 6A is an exploded view of the toy system in FIG. 1.

FIG. 6A is an exploded view of the toy system 100 shown in FIG. 1. As discussed with respect to FIG. 5A above, in certain embodiments, the handle 110 comprises the shaft base 111, the shaft 112, and the interacting structure 114. In certain embodiments, the handle 110 is assembled with the bottle lid 120, the rotating plate 126, the capsule 128, the compression spring 124, and the barrel lid 130.

In certain embodiments, the barrel lid 130 comprises a column 132 with a hole 134 formed therethrough. In certain embodiments, the column 132 and the hole 134 have hexagonal shapes. In certain embodiments, the rotating plate 126 comprises a hole 125. In certain embodiments, the hole 125 can have the same dimensions as the hole 134 in the barrel lid 130. When assembled, the shaft 112 of the handle 110 is engaged with the hole 125 in the rotating plate 126 and the hole 134 in the barrel lid 130. In certain embodiments, the larger width of the shaft 112 matches but is slightly smaller than the dimensions of the holes 125, 134. As such, when engaged the handle shaft 112 is rotationally keyed with the hole 125 in the rotating plate 126 and the hole 134 in the barrel lid 130. In this way, rotating the handle 110 rotates the rotating plate 126 and the barrel lid 130. Since the barrel lid 130 and the barrel 140 are tightly coupled together by the one or more O-rings 136, the barrel 140 also rotates with the handle 110.

The coupling between the handle 110 and the bottle lid 120 is by engagement between the handle base 111 and a lid hole 121. Since both the handle base 111 and the lid hole 121 are round and the lid hole 121 is slightly larger than the handle base 111, rotation of the handle 110 does not cause the bottle lid 120 to rotate.

When the handle 110 is pressed downward to the lowered position, the handle 110 compresses the compression spring 124 disposed between the rotating plate 126 and the barrel lid 130, as shown in FIG. 5A. On the other hand, between the hole 134 in the barrel lid 130 and the handle shaft 112 there is a small gap. As such, the force pushing down the handle 110 moves the handle shaft 112 downward freely through the hole 134 and is exerted on a top of the capsule 128.

As shown in FIG. 5A, the capsule 128 comprises a shell 127 and a plate 129, forming a closed enclosure adapted to hold a material. In certain embodiments, the material is a liquid clarifying substance. In certain embodiments, the material is a powder clarifying substance. In certain embodiments, the shell 127 is vacuum-formed plastic and the plate 129 is a thin film potentially made of plastic, metal or combined metal and plastic layers. In certain embodiments, the plate 129 is assembled to the shell 127 by heat staking, adhesive, ultrasonic welding, vibration welding, or induction heating. In certain embodiments, the shell-to-plate assembly is done with the plate 129 facing upward after the material is placed into the shell 127. In FIG. 5A, when the force from the handle 110 is applied to the capsule 128, the capsule 128 moves in a downward direction causing the one or more spikes 138 to pierce the plate 129 of the capsule 128 and release the liquid or solid material in the capsule 128. In certain embodiments, the material flows into the inter-wall space 151.

In certain embodiments, the capsule 128 has three quarters of a ring or annular shape. In certain embodiments, when assembled, the open portion of the ring capsule 128 is aligned with the hole 122 on the bottle lid 120 and a hole on the rotating plate 126 to form a channel. In certain embodiments, the channel connects the inter-wall space 151 to the outside of the toy system 100. Since the barrel lid 130 does not have a matching opening, the channel stops at the inter-wall space 151. In certain embodiments, the internal space 141 inside the barrel 140 is isolated from the channel and the inter-wall space 151.

A handle lock 116 shown in FIG. 6A is installed between the handle 110 and the bottle lid 120 to limit movement of the handle 110 during shipping and storage. After the handle lock 116 is removed, the user can actuate the handle 110 (e.g., rotating and/or pressing).

In certain embodiments, the handle 110, the handle lock 116, the bottle lid 120, the rotating plate 126, and the barrel lid 130 can be made of injection molded plastics. In certain embodiments, the compression spring 124 can be made of metal or plastic. In certain embodiments, the one or more O-rings 136 can be made of rubber or closed-cell foam. In certain embodiments, the bottle 150 and the barrel 140 can be made of blow molded plastics or blow molded glass.

Figure 6B:
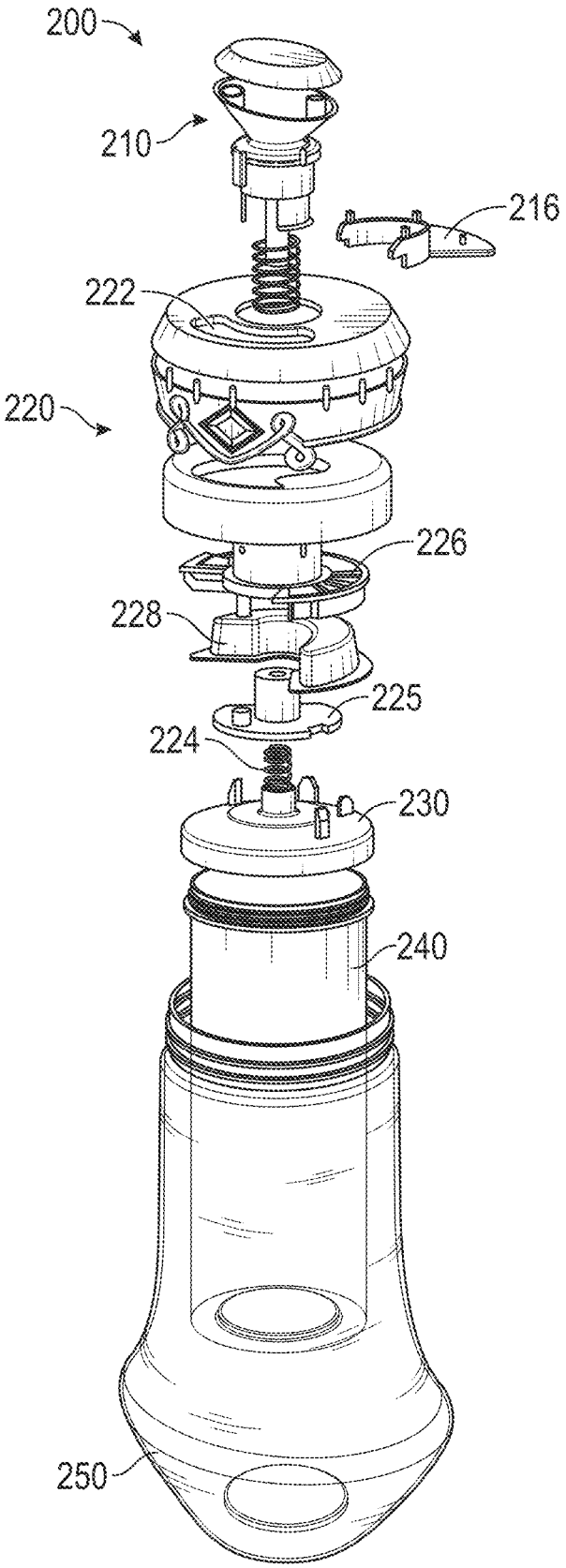
FIG. 6B is an exploded view of the toy system in FIG. 2.

Referring to FIG. 6B, an exploded view of the toy system 200 of FIG. 2 is shown. In certain embodiments, the handle 210 comprises more than one part to be assembled. The bottle lid 220 comprises more than one part, e.g., two. The handle 210 and the bottle lid 220 function substantially the same as the handle 110 and the bottle lid 120 for the toy system 100, respectively.

As described with respect to FIG. 6A for the toy system 100, in certain embodiments, the handle 210 is assembled with the bottle lid 220, the rotating plate 226, the capsule 228, the support plate 225, the compression spring 224, and the barrel lid 230. When assembled, the handle 210 is rotationally keyed with the rotating plate 226, the capsule 228, the support plate 225, and the barrel lid 230, which is tightly coupled to the barrel 240. As such, rotating the handle 210 rotates the barrel 240 and the components that are keyed therewith. Since the handle 210 is coupled with the bottle lid 220 through a hole formed in the bottle lid 220 with clearance, rotating the handle 210 does not cause the bottle lid 220 (thus, the bottle 250) to rotate.

When the handle 210 is pressed downward to the lowered position, the handle 210 compresses the compression spring 224 disposed between the support plate 225 and the barrel lid 230, as shown in FIG. 5C.

Meanwhile, the shortening of the compression spring 224 is accomplished by the downward movement of the capsule 228. As can be seen in FIG. 5C, further downward movement of the capsule 228 causes the one or more spikes 238 to pierce the thin plate 229 of the capsule 228. As such the liquid or solid powder material contained in the capsule 228 is released through the pierced hole(s). In certain embodiments, the material flows into the inter-wall space between the barrel 240 and the bottle 250.

In certain embodiments, the capsule 228 has three quarters of a ring or annular shape. In certain embodiments, when assembled, the open portion of the ring capsule 228 is aligned with a hole 222 on the bottle lid 220 and a hole on the rotating plate 226 to form a channel. In certain embodiments, the channel connects the inter-wall space to the outside of the toy system 200. Since the barrel lid 230 does not have a matching opening, the channel stops at the inter-wall space. In certain embodiments, the internal space 241 inside the barrel 240 is isolated from the channel.

A handle lock 216 shown in FIG. 6B is installed in the neck portion between the handle 210 and the bottle lid 220 to limit movement of the handle 210 during shipping and storage. After the handle lock 216 is removed, the user can actuate the handle 210 (e.g., rotating and/or pressing).

Figure 7:
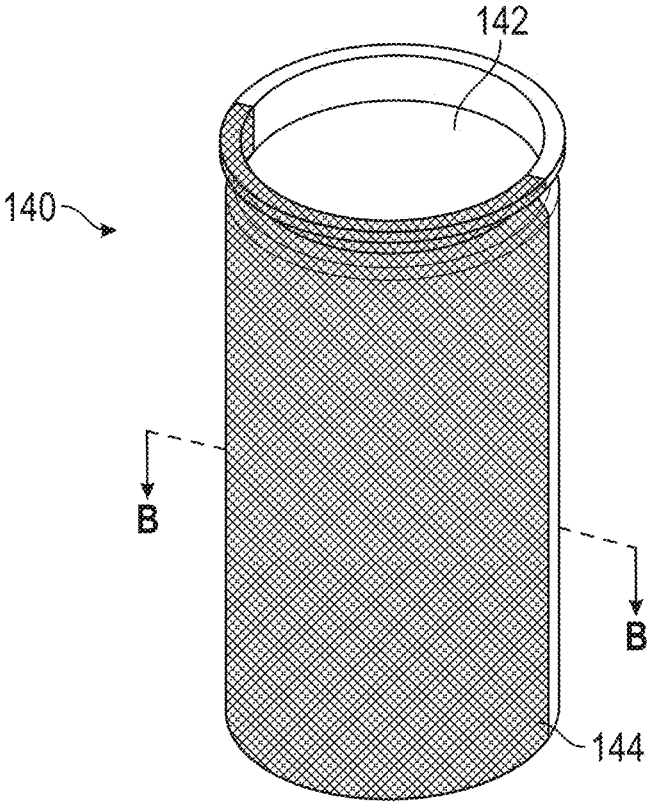
FIG. 7 is a perspective view of the barrel from FIG. 6A showing a transparent or translucent portion and an opaque portion of the barrel.
Figure 8:
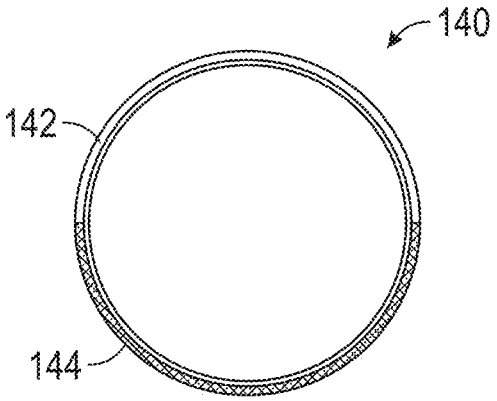
FIG. 8 is a cross-sectional view through the barrel in FIG. 7.

FIG. 7 is a perspective view of the barrel 140 from FIG. 6A showing a transparent or translucent portion 142 on the backside and an opaque portion 144 on the frontside of the barrel 140. FIG. 8 is a cross-sectional view through the barrel 140 taken along B-B in FIG. 7. As shown in FIGS. 7 and 8, the wall of the barrel 140 is divided into two portions, the transparent/translucent portion 142 and the opaque portion 144. In certain embodiments, the separation of the portions 142, 144 are straight vertical lines, curved and/or zig-zag lines. In certain embodiments, the opaque portion 144 has an opaque color pattern, which may include a uniform color, a patterned color, graphics, and/or a color image that blocks the user's view. In certain embodiments, the transparent or translucent portion 142 allows light to at least partially pass through so that the user can see what is inside the barrel 140. In certain embodiments, the opaque color pattern or image on the opaque portion 144 of the barrel wall can be applied by shrink-wrap, direct printing, etching, or as a label. In certain embodiments, the width of the opaque portion 144 is at least as wide as the width of the transparent/translucent portion 142. In certain embodiments, a slightly wider opaque portion 144 will better hide the internal space 141 during the play.

Figure 9:
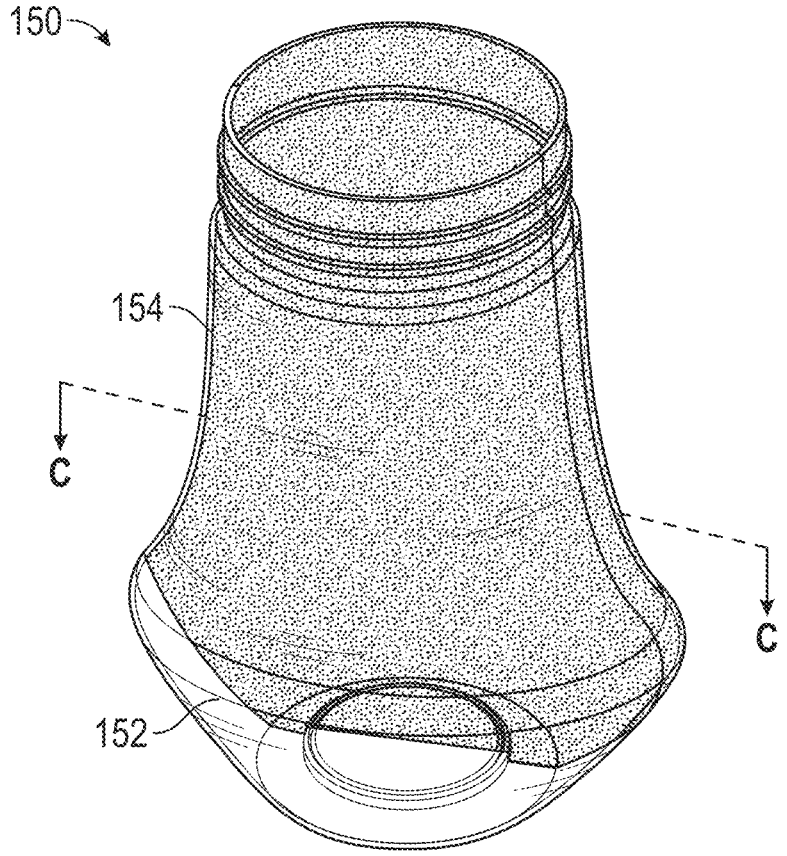
FIG. 9 is a perspective view of the bottle from FIG. 6A showing a transparent or translucent portion and an opaque portion of the bottle.
Figure 10:
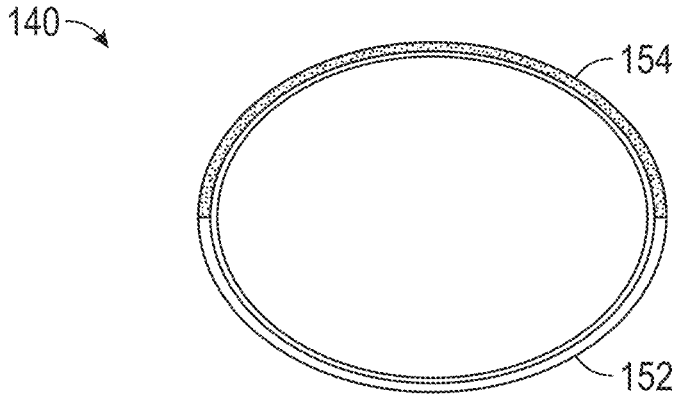
FIG. 10 is a cross-sectional view through the bottle in FIG. 9.

FIG. 9 is a perspective view of the bottle 150 from FIG. 6A showing a transparent or translucent portion 152 on the frontside and an opaque portion 154 on the backside of the bottle 150. FIG. 10 is a cross-sectional view through the bottle 150 along C-C in FIG. 9. As shown in FIGS. 9 and 10, the wall of the bottle 150 is divided into two portions, the transparent/translucent portion 152 and the opaque portion 154. In certain embodiments, the separations of the portions 152, 154 are straight vertical lines, curved and/or zig-zag lines. In certain embodiments, the opaque portion 154 has an opaque color pattern, which may include a uniform color, a patterned color, graphics, and/or a color image that blocks the user's view. In certain embodiments, the transparent or translucent portion 152 allows light to at least partially pass through so that the user can see through the bottle 150. In certain embodiments, the opaque color pattern or image on the opaque portion 154 of the bottle wall can be applied by shrink-wrap, direct printing, etching, or as a label. In certain embodiments, the width of the opaque portion 154 is at least as wide as the width of the transparent/translucent portion 152.

Figure 11:
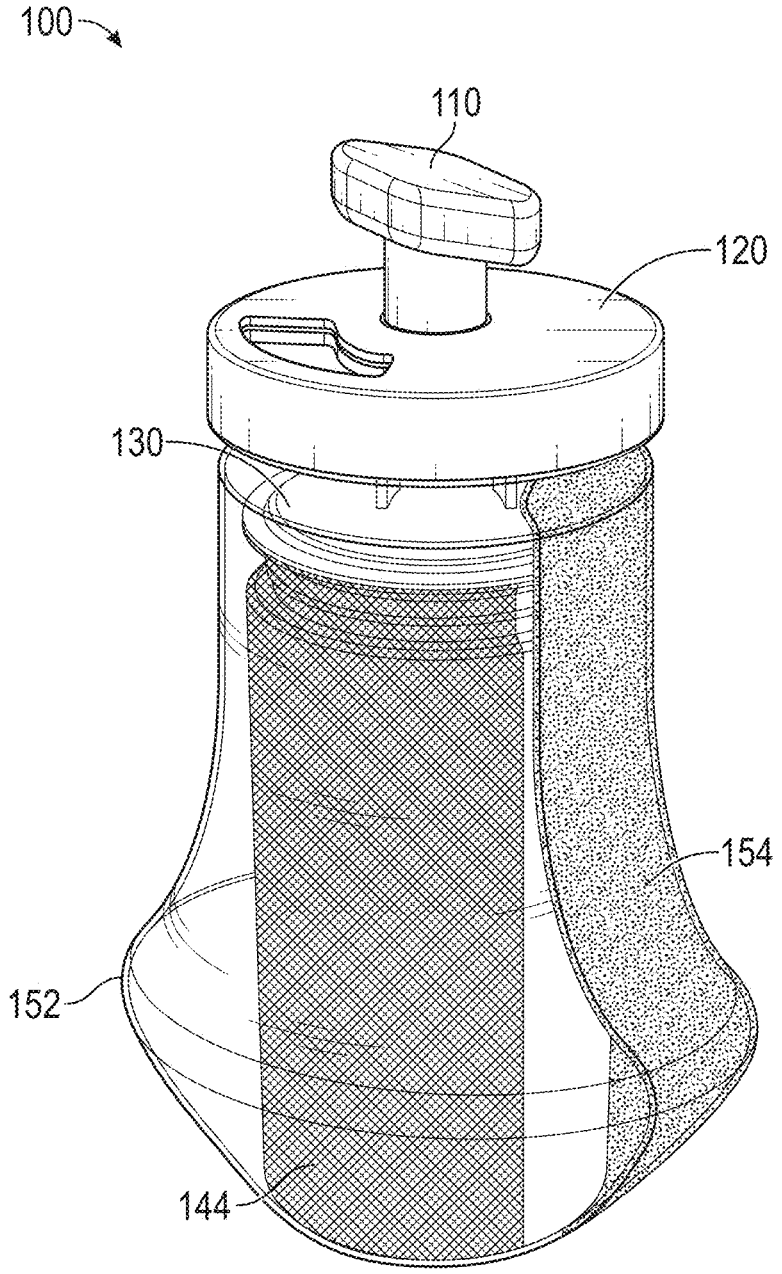
FIG. 11 is a perspective view of the toy system in FIG. 1 with the barrel rotated to a first position relative to the bottle so as to block a user from seeing inside an internal space within the barrel.

FIG. 11 is a perspective view of the toy system 100 in FIG. 1 with the barrel 140 rotated to a first position relative to the bottle 150 so as to block a user from seeing inside the internal space 141 within the barrel 140. In certain embodiments, the barrel 140 and the bottle 150 are assembled according to the orientations depicted in FIGS. 7-11. For example, the opaque portion 154 of the bottle 150 and the opaque portion 144 of the barrel 140 can be oriented opposite to each other, and cover the whole circumference of the toy system 100. In this way, during a play, the internal space 141 is totally blocked from view by the opaque walls. In certain embodiments, a slightly wider opaque portion 154 of the bottle 150 and a slightly wider opaque portion 144 of the barrel 140 will form slight overlaps at the edges so that view into the internal space 141 is more effectively blocked. These slight overlaps can cover manufacturing tolerance or small assembly errors. In certain embodiments, if the dividing lines on the barrel 140 are not straight vertical lines, but curved, zig-zag lines are other types, the dividing lines on the bottle 150 should match the shape of the dividing lines on the barrel 140 in order to obfuscate the entire circumference.

Figure 12:
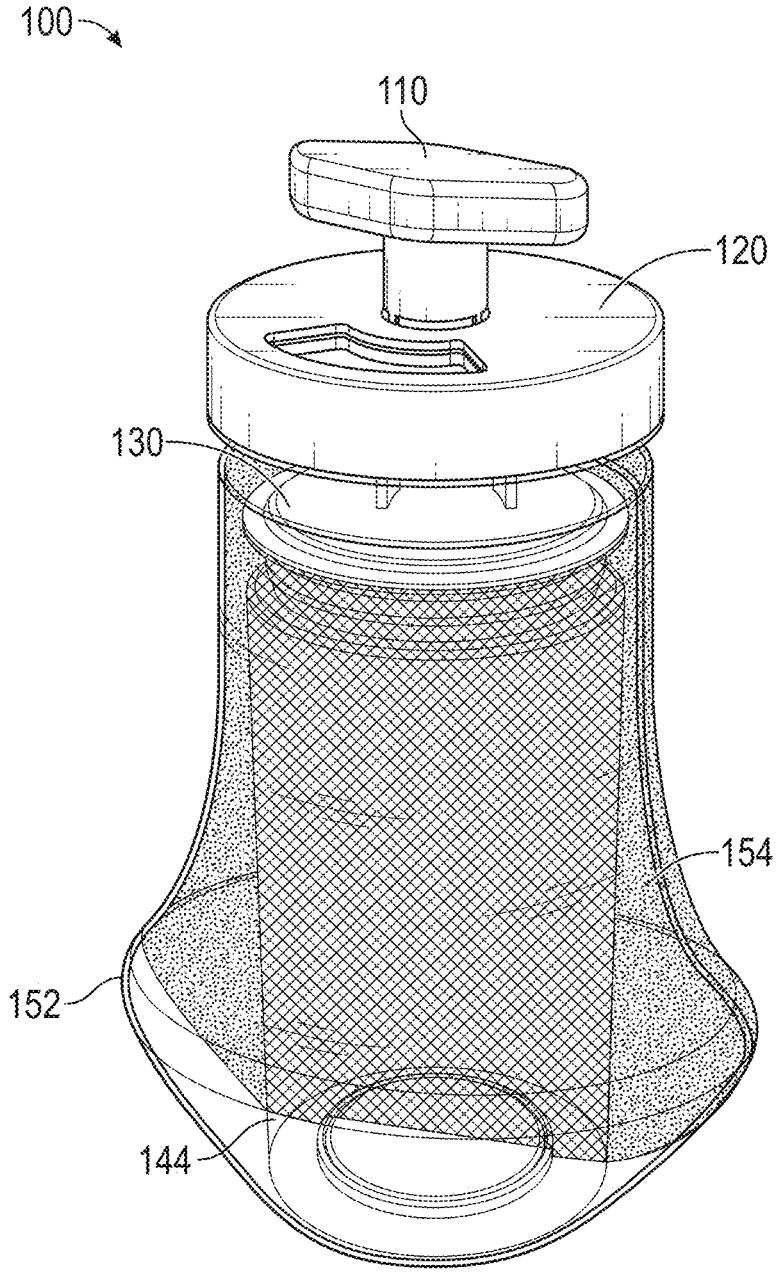
FIG. 12 is a perspective view similar to FIG. 11 except the barrel has been rotated inside the bottle to a second position relative to the bottle so as to permit the user to see the inside of the internal space within the barrel.

FIG. 12 is a perspective view similar to FIG. 11 except the barrel 140 has been rotated inside the bottle 150 to a second position relative to the bottle 150 so as to permit the user to see the inside of the internal space 141 within the barrel 140. As described with FIG. 6A, when the handle 110 rotates, the barrel 140 rotate as well. This rotation causes part of the opaque portion 144 of the barrel 140 to overlap with the opaque portion 154 of the bottle 150. As such, at least part of the transparent/translucent portion 142 of the barrel 140 overlaps with the transparent/translucent portion 152 of the bottle 150. The overlapped transparent/translucent portions 142, 152 of the barrel 140 and the bottle 150 allow the user to see inside the barrel 140. In certain embodiments, when the handle 110 is rotated 180° from the manufactured or factory state illustrated in FIG. 11, the overlap between the opaque portion 144 and the opaque portion 154 is at its maximum. Accordingly, the transparent/translucent portion 142 completely overlaps with the transparent/translucent portion 152 as shown in FIG. 12. In this orientation as shown in FIG. 12, the internal space 141 inside the barrel 140 is revealed to the user.

In certain embodiments, the toy system 200 shown in FIGS. 2, 5B and 6B can be constructed the same way as described with respect to FIGS. 7-11, and perform the same way. For example, rotating the handle 210 can rotate the barrel 240 to rotate accordingly, so as to cause opaque portions of the bottle 250 and the barrel 240 to obfuscate the view of the user, or allow the user to view the internal space 241 of the toy system 200.

Figure 13:
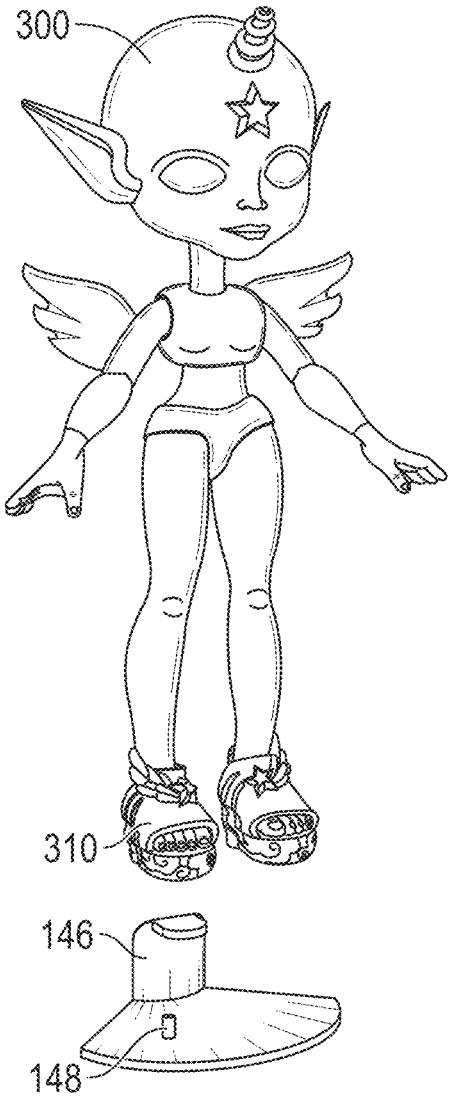
FIG. 13 is an exploded perspective view of a figurine and a mounting structure that can be disposed inside the barrel to support the figurine.

FIG. 13 is an exploded perspective view of a figurine 300 and a mounting structure 146 that can be disposed inside the barrel 140 to support a figurine 300. The figurine 300 is illustrated with the mounting structure 146 having a mounting pin 148. The mounting structure 146 can be adapted to be attached to the bottom surface of the barrel 140. As such when the figurine 300 is mounted on the mounting structure 146 during assembly, it is disposed within the internal space 141 of the barrel 140, facing the transparent/translucent portion 142 of the barrel wall. The figurine 300 may be a doll, beast, monster, or any suitable toy.

Figure 14A:
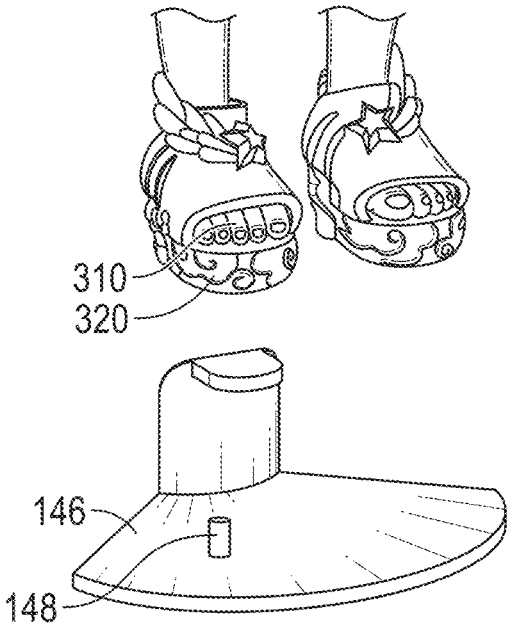
FIGS. 14A and 14B show are a series of views for mounting the figurine to the mounting structure of FIG. 13.
Figure 14B:
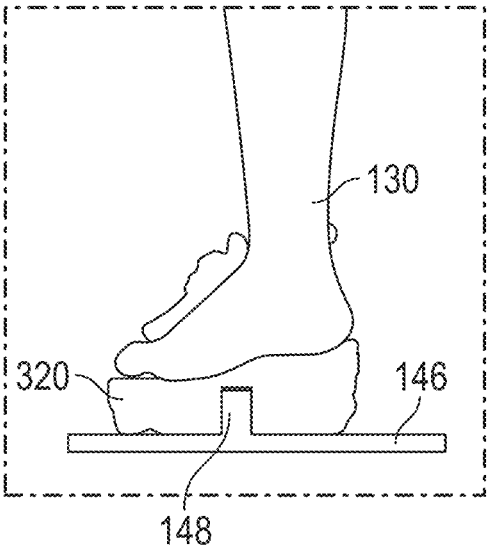

FIGS. 14A and 14B show views for mounting the figurine 300 to the mounting structure 146 of FIG. 13. FIG. 14A is a close-up view of the figurine's feet 310 each wearing a shoe 320 on the foot 310 and the mounting structure 146 separated from the feet 310. In FIG. 14B, the mounting pin 148 of the mounting structure 146 is illustrated as being engaged with a hole on a sole of the shoe 320. In certain embodiments, the figurine 300 can be loaded inside the internal space 141, 241 of the barrel 140, 240 by pushing the figurine 300 down to engage the mounting pin 148 into the hole in the shoe 320, and can then be removed from the internal space 141, 241 by pulling the figurine 300 up to disengage the mounting pin 148.

Figure 15:
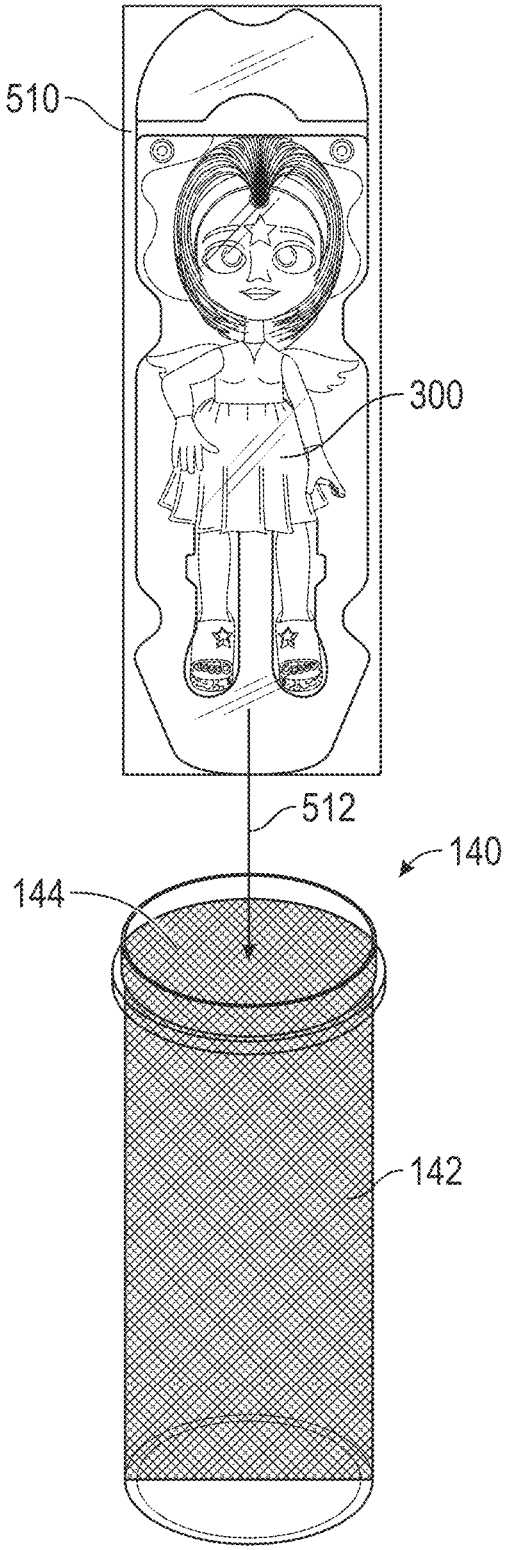
FIG. 15 illustrates an outline of the figurine from FIG. 13 disposed in a blister package which can then be assembled within the barrel of the toy system in FIG. 1.

FIG. 15 illustrates the figurine 300 from FIG. 13 disposed in a blister package 510 which can then be assembled within the barrel 140 of the toy system 100 in FIG. 1. In some embodiments, the figurine 300 can be packaged in the blister package 510, and then the blister package 510 can be placed into the barrel 140 following the loading direction 512, allowing the figurine 300 to face the transparent/translucent portion 142 of the barrel wall.

Figure 16A:
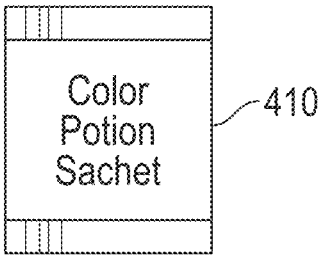
FIGS. 16A-16C illustrate exemplary ingredients that can be added to the toy system as part of a toy revealing process.
Figure 16B:
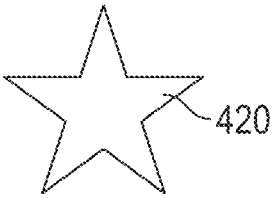
Figure 16C:
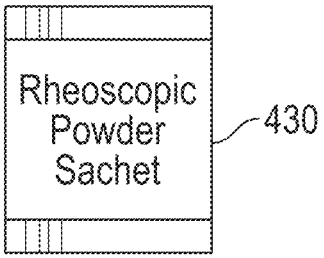

FIGS. 16A, 16B, 16C illustrate examples of ingredients that can be added to the toy system 100 as part of a toy revealing process. For example, play materials or ingredients can be added to the inter-wall space 151 between the bottle 150 and the barrel 140 during the play. Exemplary materials can include a color potion sachet 410 which comprises mainly colorant, e.g., dye, a dissolvable paper 420, a rheoscopic powder sachet 430 which allows visualization of dynamic currents in fluids, and other ingredients that adds special visual effects to the fluid. The play materials or ingredients shown in FIGS. 16A, 16B, 16C may be individually packaged in small foil or plastic bags, and loaded into the package, potentially a cardboard box, that contains the toy system 100.

Figure 17A:
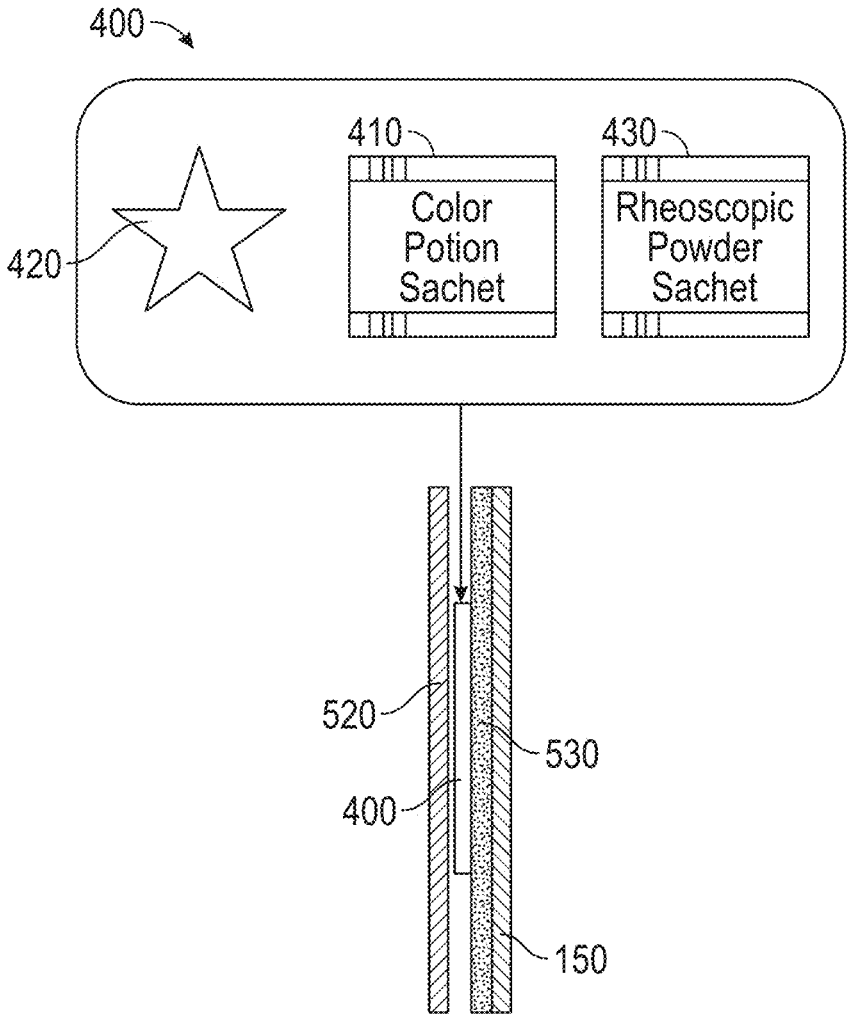
FIGS. 17A and 17B illustrate example of packaging the toy system in FIG. 1 by shrink wrapping the ingredients with the toy system.
Figure 17B:
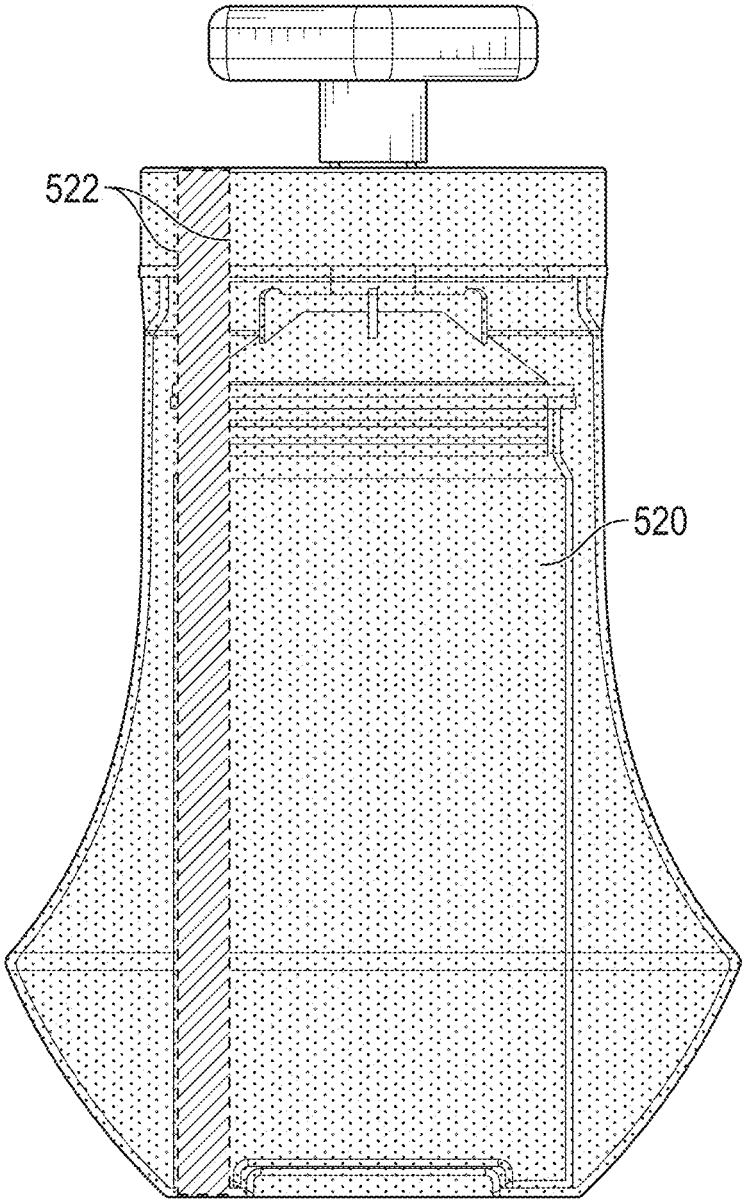

FIGS. 17A and 17B illustrate another embodiment where the play materials are shrink-wrapped onto the bottle 150, 250. In FIG. 17A, the ingredients are first packaged into an ingredient bag 400. Then the ingredient bag 400 is bundled to the bottle 150, 250 by a layer of shrink-wrap 520. A layer 530 represents a shrink-wrap layer to create the opaque portion on the bottle 150, 250. Since the opaque portion can be formed in other ways, such as printing, labeling or etching, some embodiments may not include the shrink-wrap layer 530. In certain embodiments, the bottle 150, 250 is a separate blow-molded bottle. In certain embodiments, the shrink-wrap 520 may include tear-away lines 522 for the convenience of opening the shrink-wrap 520 and get the ingredient bag 400.

In some embodiments, during the process of opening the packaging of the toy system 100, 200 to access the toy inside the barrel 140, 240, the user or a group of users are advised to follow certain steps. In certain embodiments, instructions, e.g., as part of a user's manual, can be disposed in the packaging. In some embodiments, when the user opens the packaging, the user locates the toy system 100, 200, a user's manual, and maybe some small bags. In some embodiments, by reading the instructions, the user knows the steps of play to reveal and get the toy or figurine 300. In some embodiments, the user can follow the following exemplary steps to play.

Locate the ingredients. There may be small bags in the package for the toy system 100, 200. In other embodiments, the ingredients may be shrink-wrapped on the bottle 150, 250 of the toy system 100, 200 or a separate blow-molded bottle. In some embodiments, the outer shrink-wrap layer of the bottle 150, 250 is torn open to access the play ingredients.

The following order may be followed. The color potion sachet (e.g., dye) 410 can be poured into the inter-wall space 151. The water can then be added to the inter-wall space 151. Add the dissolvable paper ingredients 420 (not limited to paper, can be other).

In certain embodiments, the rheoscopic powder sachet 430 can be poured into the inter-wall space 151. In certain embodiments, a second color potion sachet 410 (or remaining dye from the first color potion sachet 410) can be poured into the inter-wall space 151. The water then turns opaque as the color potion mixes with the water and other ingredients. In embodiments that include the rheoscopic powder, the rheoscopic powder may cause dynamic flow patterns in the liquid.

Shake the toy system 100, 200 a few times to mix, e.g., around 3 times.

Remove the handle lock 116, 216 from around the neck under the handle 110, 210. Removing the handle lock 116, 216 allows you to turn the handle 110, 210 on top of the toy system 100, 200 about 180. By turning the handle the internal barrel turns 180 degrees.

Figure 18:
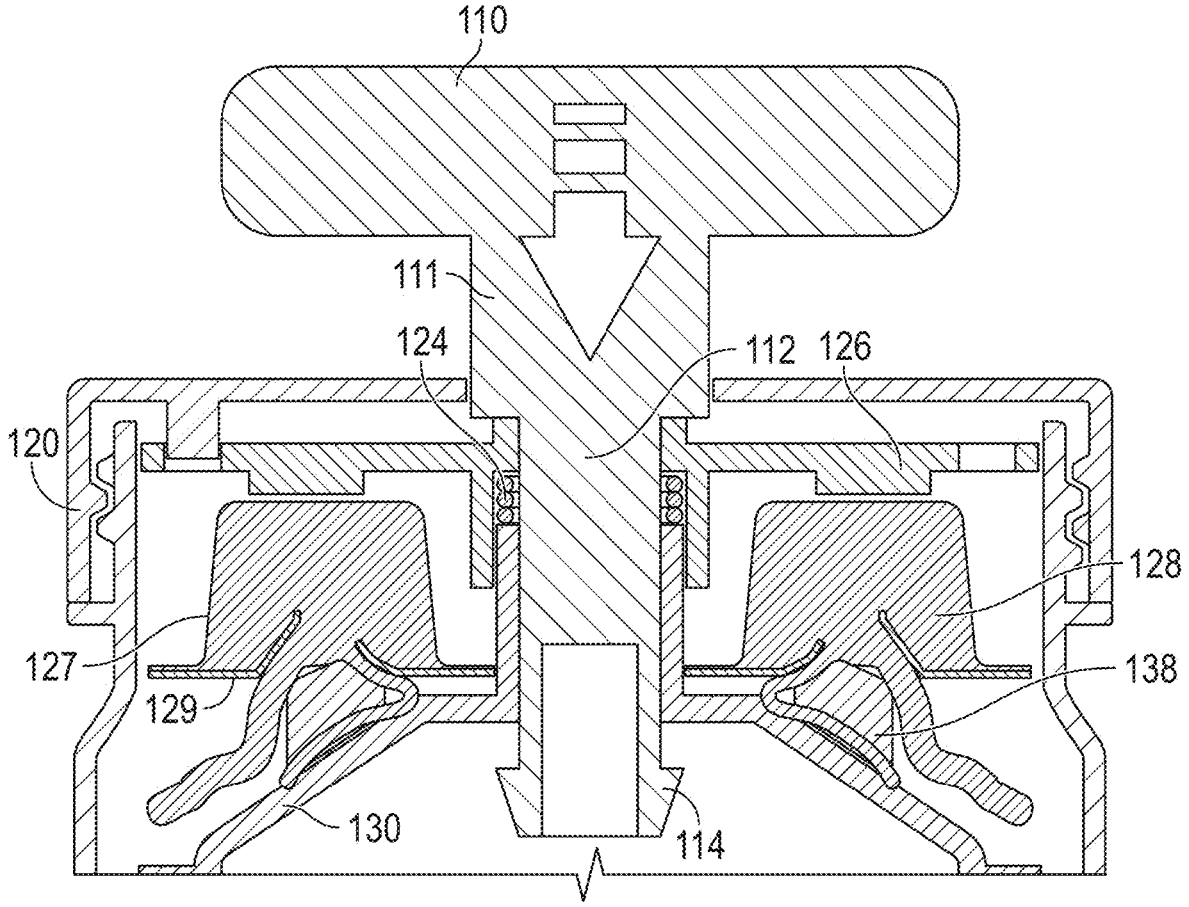
FIG. 18 is a cross-sectional view similar to FIG. 5A except the handle has been moved to a lowered position puncturing a capsule of clarification ingredients. The punctured capsule releases the clarification ingredients into a space between the bottle and the barrel.

Push down the handle 110, 210. As discussed with respect to FIGS. 5, 6A, 6B and more clearly shown in FIG. 18, this causes the one or more spikes 138, 238 to penetrate the plate 129, 229 of the capsule 128, 228 to release the material or ingredient into the inter-wall space. The ingredients loaded in the capsule 128, 228 may be a clarifying agent that causes the fluid in the inter-wall space to go from an opaque color full state to a transparent state in a short time.

Figure 19:
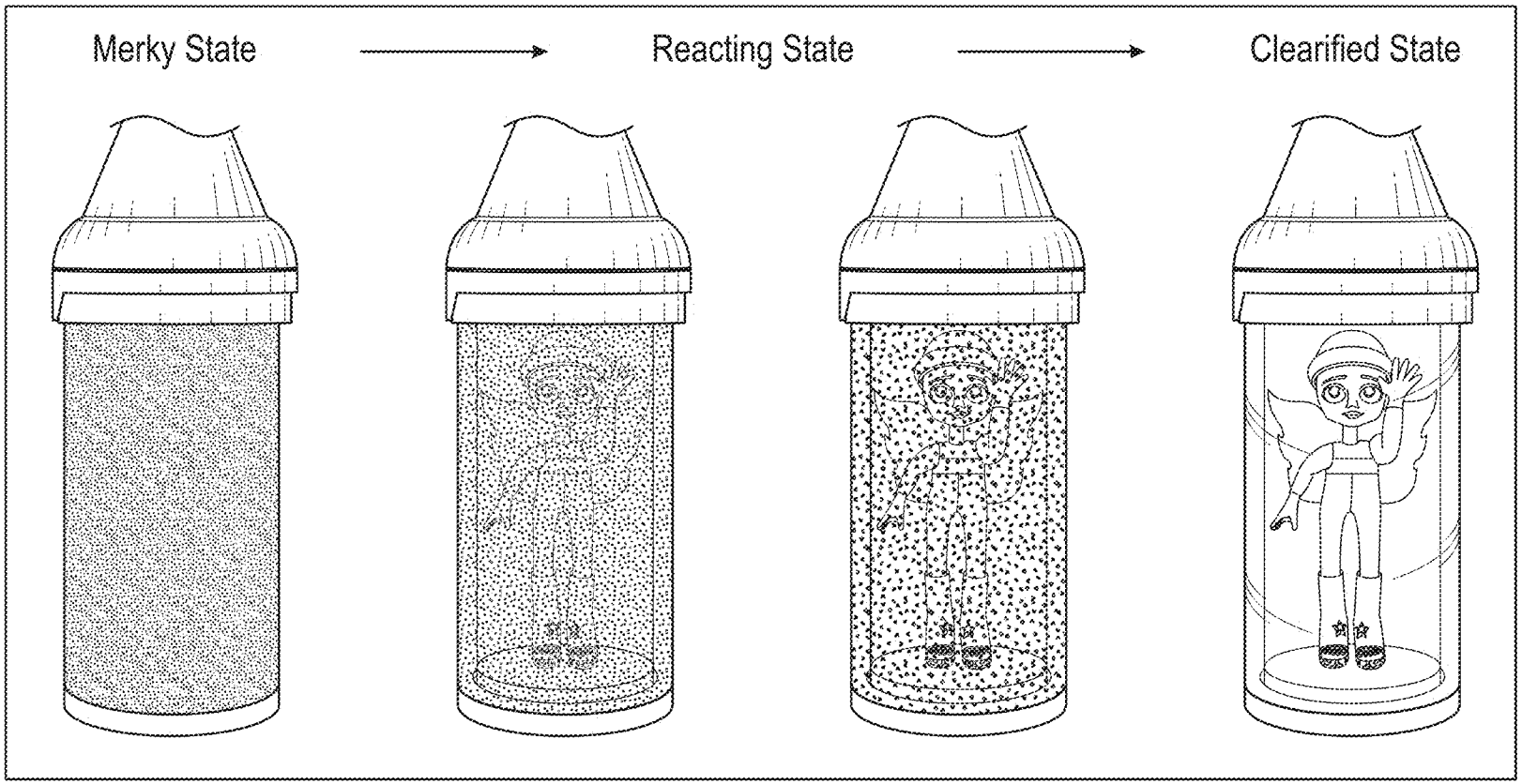
FIG. 19 illustrates an example of a process by which the figurine is slowly revealed as the opacity of the liquid changes and the barrel is rotated within the bottle to the second position.

Wait when the fluid changes from the color state to the transparent state. This clarifying process is illustrated in FIG. 19.

Unscrew the bottle lid 120, 220 to open the bottle 150, 250. Pull up the handle 110, 210 and the barrel 140, 240 that is connected to the handle 110, 210. Then disconnect the barrel lid 130, 230 and the barrel 140, 240.

Pull the figurine 300 out of the barrel 140, 240. If the figurine is packaged in a blister pack 510, remove the blister pack to get the figurine 300.

Figure 20:
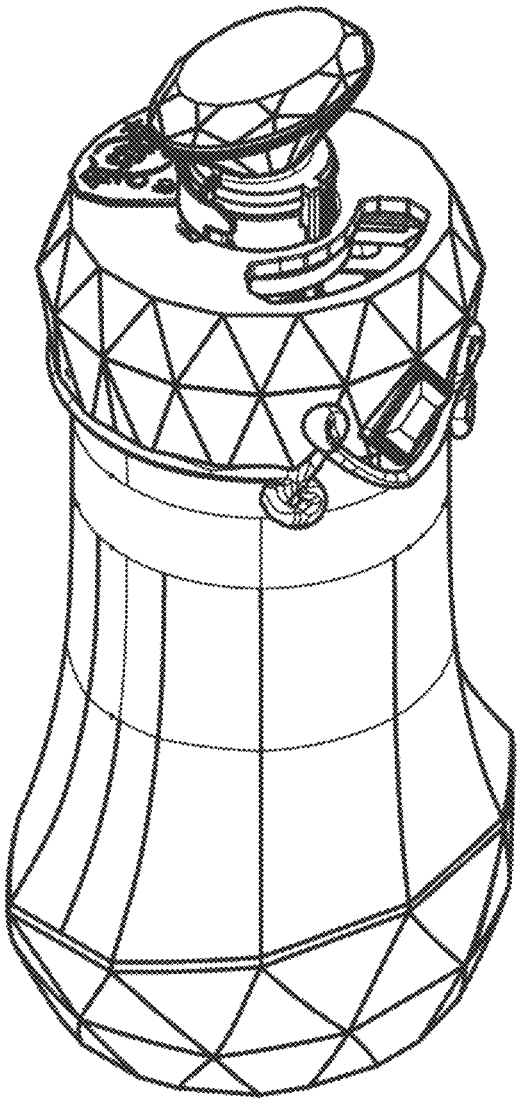
FIG. 20 is a front, left, top perspective view of an embodiment of the toy system.
Figure 21:
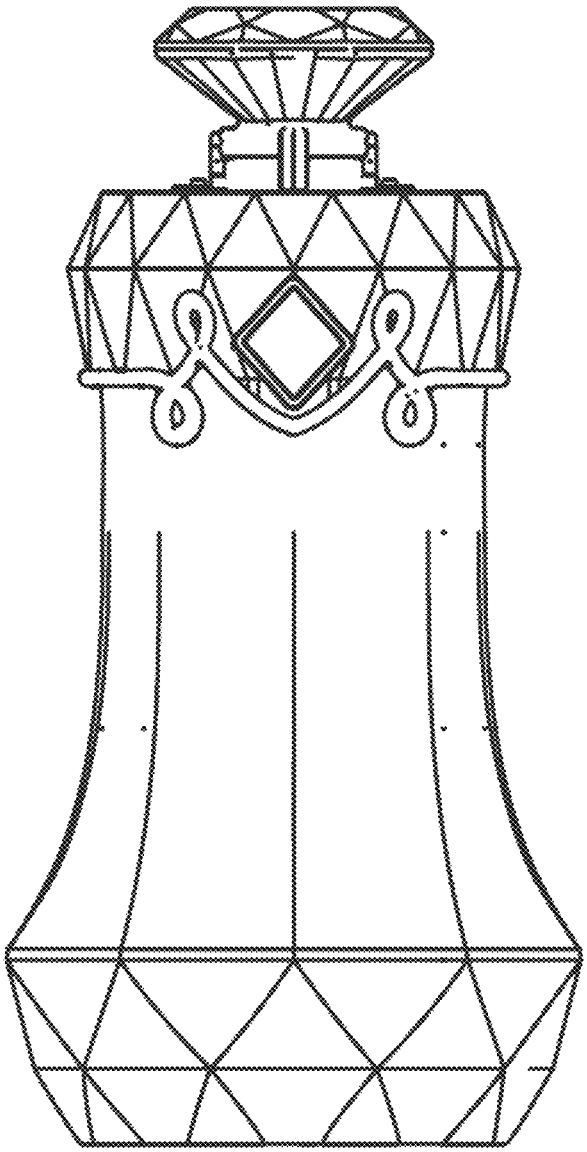
FIG. 21 is a front plan view of the toy system of FIG. 20.
Figure 22:
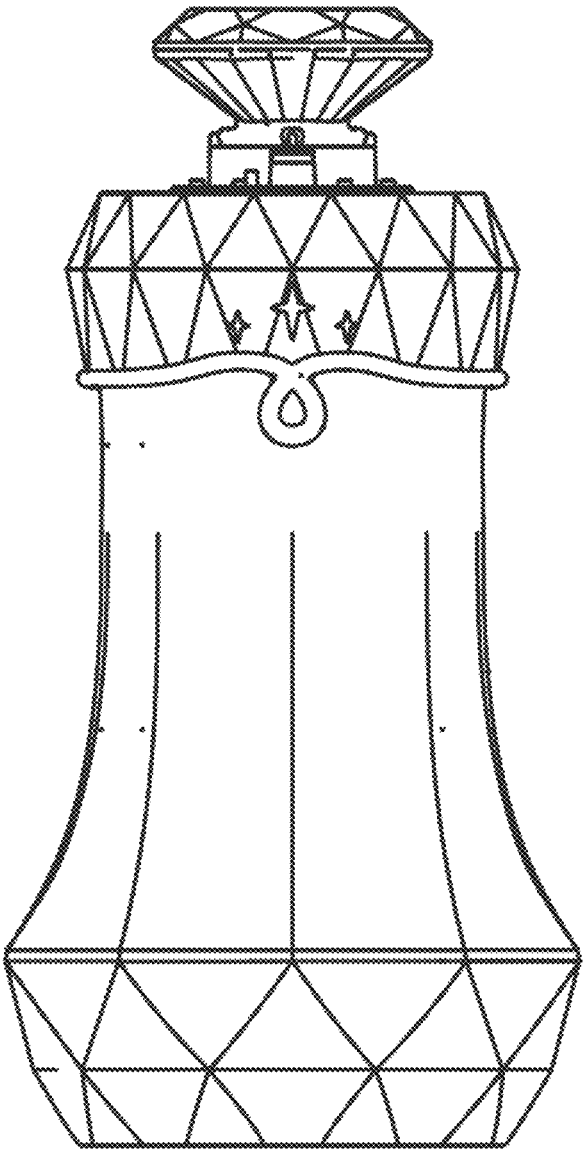
FIG. 22 is a back plan view of the toy system of FIG. 20.
Figure 23:
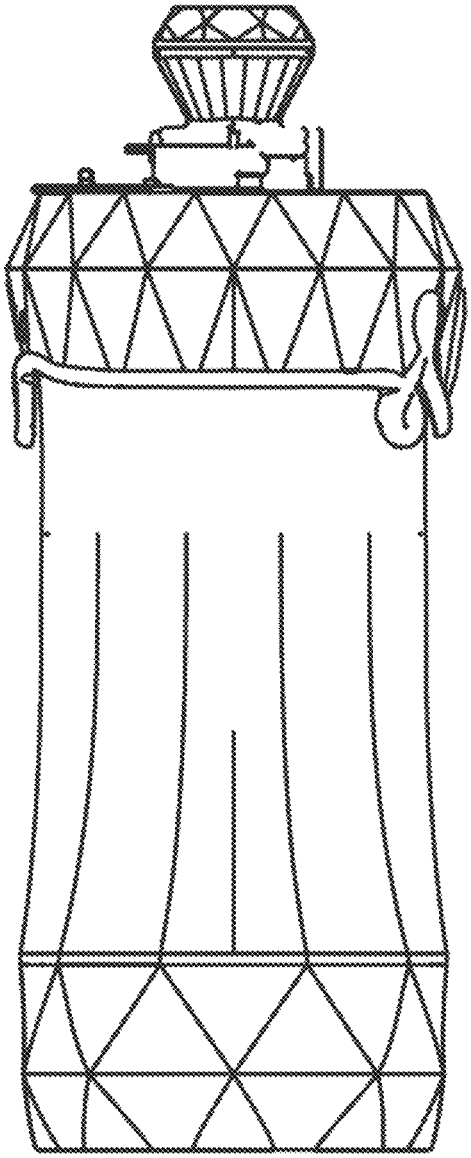
FIG. 23 is a left-side plan view of the toy system of FIG. 20.
Figure 24:
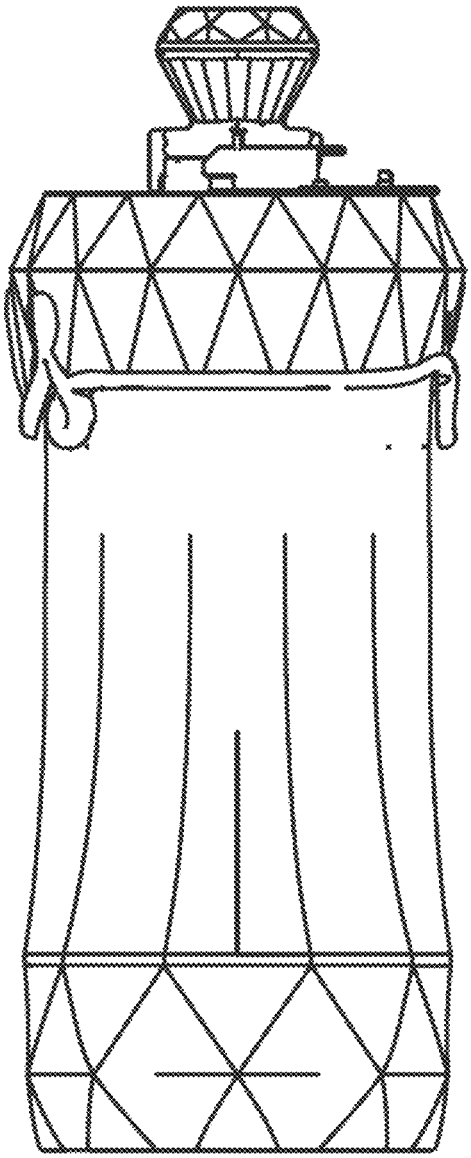
FIG. 24 is a right-side plan view of the toy system of FIG. 20.
Figure 25:
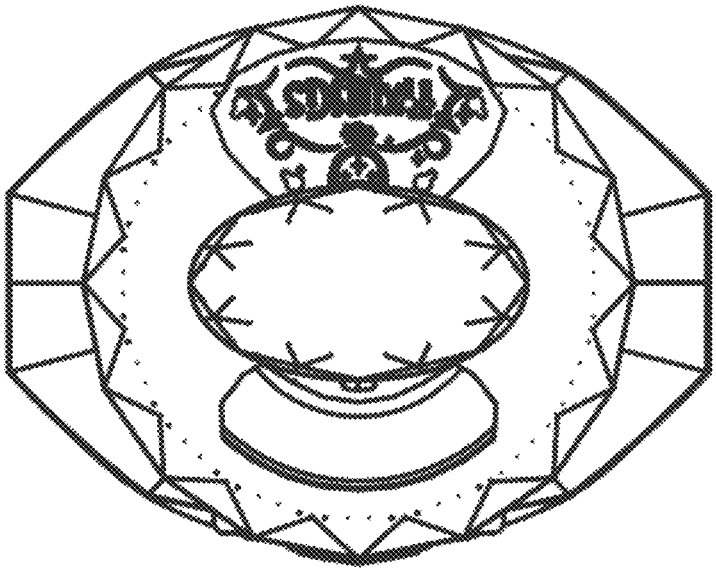
FIG. 25 is a top plan view of the toy system of FIG. 20.
Figure 26:
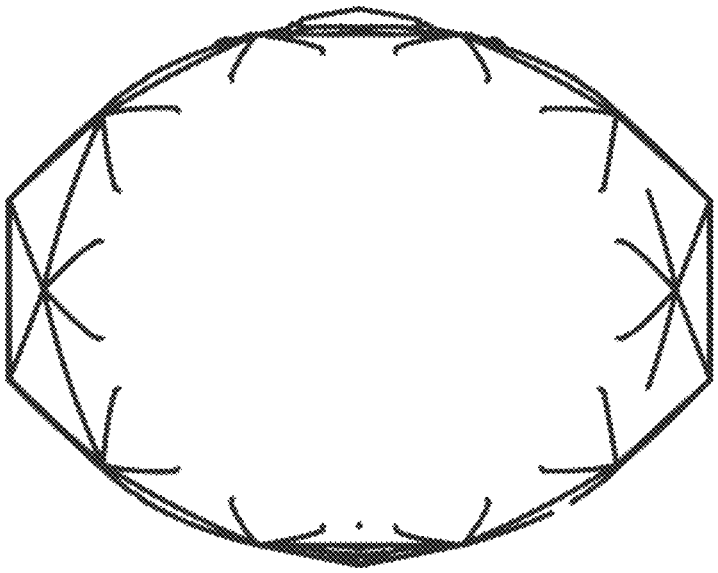
FIG. 26 is a bottom plan view of the toy system of FIG. 20.

FIG. 20 is a front, left, top perspective view of an embodiment of the toy system. FIG. 21 is a front plan view of the toy system of FIG. 20. FIG. 22 is a back plan view of the toy system of FIG. 20. FIG. 23 is a left-side plan view of the toy system of FIG. 20. FIG. 24 is a right-side plan view of the toy system of FIG. 20. FIG. 25 is a top plan view of the toy system of FIG. 20. FIG. 26 is a bottom plan view of the toy system of FIG. 20.

Terminology

Although certain embodiments and examples are disclosed herein, inventive subject matter extends beyond the examples in the specifically disclosed embodiments to other alternative embodiments and/or uses, and to modifications and equivalents thereof. Thus, the scope of the claims appended hereto is not limited by any of the particular embodiments described above. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

For expository purposes, the term "horizontal" as used herein is defined as a plane parallel to the plane or surface of the floor or ground of the area in which the device being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

What is claimed is:

1. A toy system having an internal space for housing a toy, comprising:

a bottle; and a barrel rotatably disposed in the bottle so as to rotate from a first position to a second position, wherein when the barrel is in the first position the internal space is not visible from outside the bottle, and wherein when the barrel is in the second position the internal space is visible from outside the bottle.

2. The toy system of claim 1, further comprising a handle configured to allow a user to rotate the barrel.

3. The toy system of claim 1, further comprising the toy disposed in the internal space, the toy being accessible when the barrel is removed from the bottle.

4. The toy system of claim 1, wherein a wall of the barrel and a wall of the bottle form an inter-wall space configured to hold a liquid.

5. The toy system of claim 4, further comprising a capsule containing an ingredient configured to mix with the liquid.

6. The toy system of claim 5, wherein the capsule is disposed in the bottle and above the barrel.

7. The toy system of claim 5, wherein the capsule is disposed in the bottle below the barrel.

8. The toy system of claim 5, wherein the ingredient is configured to change a transparency of the liquid.

9. The toy system of claim 5, wherein the ingredient is configured to create fizz in the liquid.

10. The toy system of claim 5, further comprising one or more spikes, wherein one of the one or more spikes or the capsule is rotatable relative to the bottle so as to align with the other one of the one or more spikes or the capsule.

11. A toy system having an internal space for housing a toy, comprising:

a bottle having an opaque portion and a transparent/translucent portion; and a barrel disposed in the bottle, the barrel being rotatable relative to the bottle from a first position to a second position, the barrel having an opaque portion and a transparent/translucent portion, wherein the opaque portion of the barrel overlaps the transparent/translucent portion of the bottle when the barrel is in the first position so that a view of the toy in the internal space from outside the bottle is obfuscated, and wherein the transparent/translucent portion of the barrel overlaps the transparent/translucent portion of the bottle when the barrel is in the second position so that the toy is visible from outside the bottle.

12. The toy system of claim 11, wherein a wall of the barrel and a wall of the bottle form an inter-wall space configured to hold a liquid.

13. The toy system of claim 12, further comprising a capsule containing an ingredient configured to mix with the liquid.

14. The toy system of claim 13, wherein the ingredient is configured to change a transparency of the liquid.

15. The toy system of claim 13, wherein the ingredient is configured to create fizz in the liquid.

16. A toy system comprising:

a barrel having an inner wall forming an internal space configured to hold a toy;

a bottle having an outer wall forming an enclosure to house at least a portion of the barrel therein, wherein the outer wall and the inner wall are spaced apart forming an inter-wall space configured to hold a liquid, at least a portion of the inner wall of the barrel and at least a portion of the outer wall of the bottle contacting the liquid; and a handle configured to rotate the barrel between at least a first position and a second position relative to the bottle.

17. The toy system of claim 16, further comprising a capsule configured to hold an ingredient, wherein actuation of the handle releases the ingredient into the inter-wall space.

18. The toys system of claim 17, wherein the ingredient is a clarifying agent configured to change a transparency of the liquid.

19. The toys system of claim 17, wherein the ingredient is configured to create fizz in the liquid.

20. The toy system of claim 16, wherein a first portion of the inner wall and a first portion of the outer wall are opaque, and wherein a second portion of the inner wall and a second portion of the outer wall are transparent or translucent.

21. The toy system of claim 20, wherein the first portion of the inner wall overlaps the second portion of the outer wall when the barrel is in the first position, and wherein the first portion of the inner wall overlaps the first portion of the outer wall when the barrel is in the second position.

22. The toy system of claim 16, wherein the liquid is opaque.

* * * * *